US007215783B2

(12) United States Patent
Tsunoda et al.

(10) Patent No.: US 7,215,783 B2
(45) Date of Patent: May 8, 2007

(54) IMAGE FORMING APPARATUS AND METHOD OF EVALUATING SOUND QUALITY ON IMAGE FORMING APPARATUS

(75) Inventors: Koichi Tsunoda, Kanagawa (JP); Satoshi Kanda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 900 days.

(21) Appl. No.: 10/026,642

(22) Filed: Dec. 27, 2001

(65) Prior Publication Data

US 2002/0150258 A1 Oct. 17, 2002

(30) Foreign Application Priority Data

| | | |
|---|---|---|
| Dec. 27, 2000 | (JP) | 2000-396769 |
| Dec. 27, 2000 | (JP) | 2000-397056 |
| Mar. 22, 2001 | (JP) | 2001-083613 |
| Jun. 11, 2001 | (JP) | 2001-175196 |
| Dec. 7, 2001 | (JP) | 2001-374924 |

(51) Int. Cl.
*H04R 29/00* (2006.01)
*G03G 21/20* (2006.01)

(52) U.S. Cl. ..... 381/56; 399/91

(58) Field of Classification Search ..... 381/56, 381/61, 58, 73.1; 399/1, 91, 411; 358/305, 358/463

See application file for complete search history.

(56) References Cited

U.S. PATENT DOCUMENTS

| | | | | |
|---|---|---|---|---|
| 4,954,849 A | | 9/1990 | Koike et al. | |
| 4,975,749 A | | 12/1990 | Tsunoda et al. | |
| 4,979,727 A | | 12/1990 | Koike et al. | |
| 5,014,091 A | | 5/1991 | Koike et al. | |
| 5,245,385 A | * | 9/1993 | Fukumizu et al. | 399/91 |
| 5,289,147 A | * | 2/1994 | Koike et al. | 399/1 |
| 5,867,748 A | * | 2/1999 | Takahashi et al. | 399/1 |
| 5,930,557 A | * | 7/1999 | Sasahara et al. | 399/91 |
| 6,308,027 B1 | | 10/2001 | Obu et al. | |
| 6,327,366 B1 | * | 12/2001 | Uvacek et al. | 381/60 |
| 6,417,435 B2 | * | 7/2002 | Chantzis et al. | 84/477 R |
| 6,609,092 B1 | * | 8/2003 | Ghitza et al. | 704/226 |
| 6,697,584 B2 | * | 2/2004 | Tsunoda et al. | 399/91 |
| 6,862,417 B2 | * | 3/2005 | Tsunoda et al. | 399/91 |
| 6,876,828 B2 | * | 4/2005 | Tsunoda et al. | 399/91 |
| 7,136,605 B2 | * | 11/2006 | Tsunoda et al. | 399/91 |

FOREIGN PATENT DOCUMENTS

| | | |
|---|---|---|
| JP | 62-9969 | 1/1987 |
| JP | 6-3929 | 1/1994 |
| JP | 8-137158 | 5/1996 |
| JP | 9-193506 | 7/1997 |
| JP | 11-20411 | 1/1999 |
| JP | 2000-155500 | 6/2000 |
| JP | 2000-206829 | 7/2000 |

* cited by examiner

*Primary Examiner*—Xu Mei
(74) *Attorney, Agent, or Firm*—Oblon, Spivak, McClelland, Maier & Neustadt, P.C.

(57) ABSTRACT

A discomfort index, S, is calculated with an equation, S=0.3135×(Loudness value)+3.4824×(Tonality value)−3.1460. This equation uses a loudness value and a tonality value, both psychoacoustic parameters obtained from a sound from the image forming apparatus at a location 1.00 m±0.03 m apart from an end of the image forming apparatus. A sound caused at the time of charging an image carrier is improved so that the discomfort index S satisfies S<−0.5.

19 Claims, 16 Drawing Sheets

COMPARISON OF FREQUENCY DISTRIBUTIONS
ON COPYING AND FREE-RUNNING

IMAGE FORMING APPARATUS AND METHOD OF EVALUATING SOUND QUALITY ON IMAGE FORMING APPARATUS

FIELD OF THE INVENTION

The present invention relates to an image forming apparatus and method of evaluating sound quality on image forming apparatus. More particularly, it relates to a method of reducing uncomfortable sounds, such as motor driving sounds, actuation sounds from clutches and solenoids, charging sounds, and paper conveying sounds, from image forming apparatus, such as xerographic copiers and laser printers, which cause noises during their operations. It also relates to a technology applicable to OA machines in general.

BACKGROUND OF THE INVENTION

In recent years, the viewpoint of friendliness to the environment raises concerns on noise problems higher and increases needs to solving the noise problem even for OA machines in offices. Accordingly, sound reduction of OA machines has been intended and actually such the sound reduction has been advanced more than before.

There are several technologies disclosed to solve such the noise problems. For example, JP 9-193506A publication discloses a technology using a noise-masking device which reduces discomfort of noises from a laser beam printer or a copier. The noise-masking device comprises a sound generator which generates a masking sound to mask noises from a drive mechanism that serves on operation as a noise source. The device also comprises a masking sound controller unit which controls and allows the sound generator to generate the masking sound having frequencies within a range that contains major component frequencies of the noises.

However, the technology disclosed in the JP 9-193506A publication has a disadvantage because it adds the masking sound to noisy sounds caused functionally from the body without reducing the noisy sounds, resulting in an elevated noise level. Therefore, some persons may feel rather noisy and more uncomfortable. In addition, the technology requires the use of the sound generator which generates the masking sound and the controller which controls the masking sound to be generated for a limited time period, during which the sounds to be masked are caused. Therefore, the technology also has a disadvantage because it requires, on layout of the machine, an extra space and greatly elevated cost.

Technologies relating to apparatus and methods of evaluating sound quality are also disclosed as described below. For example, JP 10-232163A publication discloses a technology for facilitating of determination on a relation between a noise and the corresponding psychological noisiness. This technology is employed, in an apparatus and method of evaluating sound quality, for evaluating only a "roaring sound" among noises consisting of sounds with many tones from image forming apparatus. The roaring sound is a heavy noise with low-frequency random noises caused from an air flow system, such as an exhausting sound.

JP 10-253440A publication discloses a technology, in an apparatus and method of evaluating sound quality, for evaluating only a "screeching sound" extracted from noises consisting of sounds with many tones from image forming apparatus. The screeching sound is a continuous pure sound caused from a scanner motor or a charger and is recognized noisy.

JP 10-253442A publication discloses a technology, in an apparatus and method of evaluating sound quality, for evaluating only a "friction sound" extracted from noises consisting of sounds with many tones from image forming apparatus. The friction sound is composed of high-frequency random noises caused from slipping of a recording paper.

JP 10-267742A publication discloses a technology, in an apparatus and method of evaluating sound quality, for evaluating only a "whir" extracted from noises consisting of sounds with many tones from image forming apparatus. The whir is composed of pure sounds that have peaks at a plurality of frequencies proximate to a humming from a drive system.

JP 10-267743A publication discloses a technology, in an apparatus and method of evaluating sound quality, for evaluating "smoothness" of a sound extracted from noises consisting of sounds of many tones from image forming apparatus. When there is no pure sound and humming, that is, no projected component is present in a frequency waveform, a person can feel such the sound as a smooth sound. Therefore, it is possible to totally call noisiness felt by a person as "smoothness".

The above conventional technologies in terms of the apparatus and method of evaluating sound quality, however, failed to propose any apparatus and method of improving sound quality on actual products though they propose the methods of evaluating sound quality.

Currently, an acoustic power level (ISO 7779) is generally employed in OA machines as an approach which evaluates a noise. The acoustic power level is a value of acoustic energy produced from an office machine such as a copier and a printer. Accordingly, there may be often no well correlation between the acoustic power level and a human subjective discomfort against the noise. For example, when sounds with the same acoustic power level are heard and compared with each other, a difference in discomfort between them may be found. In addition, even if a sound has a low acoustic power level, a person may feel the sound extremely uncomfortable.

Accordingly, a further improvement on the office environment requires reduction of the acoustic power level of an OA machine as well as progression in improvement on its sound quality. The improvement on the sound quality requires a quantitative measurement of the sound quality to grasp the current situation and a measurement of an improved degree after the improvement. However, the sound quality is not a physical quantity and accordingly can not be measured quantitatively. Namely, when sounds are listened to through ears to compare their qualities with each other, a difference may occur in evaluations according to persons. In addition, an expression can be performed only qualitatively such that "the sound quality was improved a little" or "considerably improved". Unless a quality of a sound can be expressed quantitatively with a physical quantity, even if measures are implemented for improvement on the sound quality, it is impossible to evaluate the effect objectively.

Psychoacoustic parameters are physical quantities employed for evaluating sound quality. Typically, the psychoacoustic parameters include the following (see, for example, The Japan Society of Mechanical Engineering, The 7th Design and Systems Conference, "Direct to innovative leaps in design and systems towards the 21st century!", Nov. 10 to 11, 1997, "Sounds/vibrations and design, colors and design (1)" division, 089B. Characters in brackets denote a unit).

Loudness (sone), Magnitude of audibility

Sharpness (acum), Relatively distributed quantity of high-frequency components

Tonality (tu), Contents of pure components

Roughness (asper), Roughness of sound

Fluctuation strength (vacil), Humming

In addition to the above, such machines are launched that can measure the following psychoacoustic parameters.

Impulsiveness (iu), Impulsive property

Relative approach, Fluctuation feeling

The above psychoacoustic parameters have a trend to indicate an increase in discomfort as either of them increases a quality. Among those, only the loudness is standardized in ISO 532B. As for other psychoacoustic parameters, the same fundamental concept can be applied, however, programs and computations are different from one another due to a unique research according to each measurement instrument maker. Therefore, measured values are slightly different from one another according to maker sin common. It is possible to improve the sound quality through an effort for reducing all of these psychoacoustic parameters.

However, it requires a great effort to prepare measures for all psychoacoustic parameters. Noises caused from OA machines such as copiers and printers are composed of many toned noises due to complexity of their mechanisms. For example, low-frequency heavy sounds, high-frequency screeching sounds and impulsive sounds are caused variably with time from a plurality of sound sources such as motors, recording papers and solenoids.

A person judges these sounds totally and decides whether he/she feels uncomfortable or not. In this case, the person can be considered to weight on a particular part that relates to the discomfort before the decision. In a word, there are psychoacoustic parameters that are greatly effect on the discomfort and psychoacoustic parameters that are less effect on the discomfort, which differ due to tones from machines. For example, in a printer that causes impulsive sounds many times at a high speed, the impulsive sounds are felt the most uncomfortable. On the contrary, in a desktop printer that causes relatively silent sounds at a low speed, as impulsive sounds are caused less, a charging sound caused on AC-charging is felt the most uncomfortable. Thus, uncomfortable parts differ case by case. Accordingly, the low-speed machine and the high-speed machine may have different parts that require improvements on the sound quality. From such the ground, by searching psychoacoustic parameters that have great improvement effects on discomfort and improving the psychoacoustic parameters to improve sound quality efficiently, the above effort can be reduced.

Accordingly, by combining psychoacoustic parameters that have great improvement effects on discomfort, then weighting the psychoacoustic parameters to derive a sound quality evaluative equation, and computing a subjective evaluation value against the discomfort using the sound quality evaluative equation, it is possible to evaluate the sound quality objectively and improve the sound quality. Further, by deciding, for a subjective evaluation value against discomfort, a degree that can eliminate the discomfort, and providing an image forming apparatus that has sound quality improved below the degree, it is possible to solve the noise-related problems in offices.

SUMMARY OF THE INVENTION

It is a first object of the present invention to provide a method of evaluating sound quality on image forming apparatus. The method is possible to apply measures for the sound quality in the image forming apparatus easily by deriving a sound quality evaluative equation using psychoacoustic parameters that have great improvement effects on discomfort sounds and allowing the sound quality to be evaluated objectively.

A second object of the present invention is, taking the above into consideration, to provide an image forming apparatus with a relieved uncomfortable feeling. This can be achieved, in a relatively slow running image formation, by deriving a sound quality evaluative equation using psychoacoustic parameters that have great improvement effects on discomfort sounds in the image forming apparatus and using the sound quality evaluative equation.

A third object of the present invention is, taking the above into consideration, to provide an image forming apparatus with a relieved uncomfortable feeling. This can be achieved, in a relatively slow running image formation, by improving a charging sound.

A fourth object of the present invention is, taking the above into consideration, to provide an image forming apparatus with a relieved uncomfortable feeling. This can be achieved, in a relatively slow running image formation, by improving a sound from a writing unit which writes on an image carrier.

A fifth object of the present invention is, taking the above into consideration, to provide an image forming apparatus with a relieved uncomfortable feeling. This can be achieved, in a relatively fast running image formation, by deriving a sound quality evaluative equation using psychoacoustic parameters that have great improvement effects on discomfort sounds in the image forming apparatus and using the sound quality evaluative equation.

A sixth object of the present invention is, taking the above into consideration, to provide an image forming apparatus with a relieved uncomfortable feeling. This can be achieved, in a relatively fast running image formation, by reducing a paper conveying sound.

A first aspect of the present invention provides a method of evaluating sound quality on image forming apparatus, comprising the steps of, collecting a sound caused from image forming apparatus at a location apart a certain distance from the image forming apparatus, measuring a psychoacoustic parameter of the collected sound, deriving a subjective evaluation value from the collected sound through a subjective evaluation, subjecting the measured psychoacoustic parameter and the subjective value to a multiple regression analysis, computing a sound quality evaluative equation for assuming a subjective evaluation value, based on a result from the multiple regression analysis, using the psychoacoustic parameter, and computing a proper range of the subjective evaluation value assumed by the sound quality evaluative equation in the image forming apparatus.

According to the first aspect, through the operations of, collecting a sound caused from image forming apparatus at a location apart a certain distance from the image forming apparatus, measuring a psychoacoustic parameter of the collected sound and deriving a subjective evaluation value from the collected sound through a subjective evaluation, subjecting the measured psychoacoustic parameter and the subjective value to a multiple regression analysis, computing a sound quality evaluative equation for assuming a subjective evaluation value, based on a result from the multiple regression analysis, using the psychoacoustic parameter, and computing a proper range of the subjective evaluation value assumed by the sound quality evaluative equation in the image forming apparatus, it is possible to derive a sound quality evaluative equation using psychoacoustic parameters that have great improvement effects on discomfort sounds, evaluating the sound quality objectively using this sound quality evaluative equation, and presenting a proper range in the image forming apparatus.

To achieve the second object, a second aspect of the present invention provides an image forming apparatus characterized by a discomfort index, S, which satisfies $S<-0.5$, wherein the discomfort index S is calculated with the following sound quality evaluative equation (a), using a loudness value and a tonality value, both psychoacoustic parameters obtained from the sound from the image forming apparatus at a location apart a certain distance from an end of the image forming apparatus, $$S=A\times(\text{Loudness value})+B\times(\text{Tonality value})+C \quad (a)$$

where coefficients A, B and C are determined $$0.247\leqq A\leqq 0.380$$

$$2.075\leqq B\leqq 4.890$$

$$-3.649\leqq C\leqq -2.643$$

According to the second aspect, an image forming apparatus is provided to relieve an uncomfortable feeling in a relatively slow running image forming apparatus. In the apparatus, a discomfort index, S, calculated with the above sound quality evaluative equation (a) using a loudness value and a tonality value, both psychoacoustic parameters, satisfies $S<-0.5$.

A third aspect of the present invention provides the image forming apparatus according to the second aspect, wherein the coefficients are determined A=0.3135, B=+3.4824 and C=−3.1460.

A fourth aspect of the present invention provides the image forming apparatus according to the second aspect, wherein the psychoacoustic parameters, obtained from the sound from the image forming apparatus at a location apart a certain distance from an end of the image forming apparatus, satisfy conditions including a sharpness value ≦2.70 acum, a roughness value ≦1.24 asper and a fluctuation strength value ≦1.31 vacil.

A fifth aspect of the present invention provides the image forming apparatus according to the second aspect, at least comprising, an image carrier for forming an image thereon, and a charging unit which applies an AC bias to charge the image carrier, wherein the AC bias has a frequency, f, which satisfies 200 Hz<f.

According to the fifth aspect, the charging unit employs an AC bias that has a frequency f, which satisfies 200 Hz<f, to relieve the uncomfortable feeling due to the AC bias.

A sixth aspect of the present invention provides the image forming apparatus according to the second aspect, further comprising a charging sound reduction unit which reduces a charging sound caused during charging from the charging unit to the image carrier.

According to the sixth aspect, the charging sound reduction unit can reduce a charging sound caused during charging from the charging unit to the image carrier.

A seventh aspect of the present invention provides the image forming apparatus according to the sixth aspect, wherein the charging sound reduction unit comprises a frequency shifter provided on the image carrier for shifting the eigenfrequency of the image carrier to a frequency different from a frequency obtained by multiplying the frequency f of the AC bias by a natural number.

According to the seventh aspect, the frequency shifter can shift the eigenfrequency of the image carrier to a frequency different from a frequency obtained by multiplying the frequency f of the AC bias by a natural number.

An eighth aspect of the present invention provides the image forming apparatus according to the seventh aspect, wherein the frequency shifter comprises a high-stiffness member for preventing the image carrier from vibrating, a sound absorber for absorbing a sound from the image carrier, or a damper for preventing the image carrier from vibrating.

According to the eighth aspect, a high-stiffness member for preventing the image carrier from vibrating, a sound absorber for absorbing a sound from the image carrier, or a damper for preventing the image carrier from vibrating can shift the eigenfrequency of the image carrier to a frequency different from a frequency obtained by multiplying the frequency f of the AC bias by a natural number.

A ninth aspect of the present invention provides the image forming apparatus according to the second aspect, at least comprising, an image carrier for forming an image thereon, and a charging unit which applies a voltage to charge the image carrier, wherein the charging unit charges the image carrier using a DC bias.

According to the ninth aspect, the charging unit charges the image carrier using a DC bias to reduce a charging sound caused during charging from the charging unit to the image carrier.

A tenth aspect of the present invention provides the image forming apparatus according to the second aspect, at least comprising, an image carrier for forming an image thereon, and an image writing unit which writes an image on the image carrier using a polygon mirror and a motor for rotationally driving the mirror, the image writing unit including a housing unit constructing a closed space for housing the motor and the polygon mirror therein, an opening formed in a portion of a side wall constructing the housing unit, and a sound absorbent chamber provided outside the housing unit and in communication with the opening.

According to the tenth aspect, the image writing unit includes a housing unit constructing a closed space for housing the motor and the polygon mirror therein, an opening formed in a portion of a side wall constructing the housing unit, and a sound absorbent chamber provided outside the housing unit and in communication with the opening, thereby improving a sound from the writing unit which writes on the image carrier and relives the uncomfortable feeling in a relatively slow running image forming apparatus.

An eleventh aspect of the present invention provides the image forming apparatus according to the tenth aspect, wherein the sound absorbent chamber has a resonant frequency resonating with a frequency of a motor sound depending on the number of revolutions of the motor.

According to the eleventh aspect, the sound absorbent chamber has a resonant frequency resonating with a frequency of a motor sound depending on the number of revolutions of the motor, thereby improving a sound from the writing unit.

A twelfth aspect of the present invention provides the image forming apparatus according to the tenth aspect, wherein the sound absorbent chamber has a resonant frequency resonating with a frequency of a wind-hurtling sound caused from revolutions of the polygon mirror.

According to the twelfth aspect, the sound absorbent chamber has a resonant frequency resonating with a frequency of a wind-hurtling sound caused from revolutions of the polygon mirror, thereby improving a sound from the writing unit.

According to a thirteenth aspect, there is provided an image forming apparatus characterized by a discomfort index, S, which satisfies $S<-0.448$, wherein the discomfort index S is calculated with the following sound quality evaluative equation (e), using a sound pressure level (A characteristic) and, a sharpness value or a psychoacoustic parameter obtained from the sound from the image forming apparatus at a location apart a certain distance from an end of the image forming apparatus, $$S=A\times(\text{Sound pressure level})+B\times(\text{Sharpness value})+C \quad \text{(e)}$$

where coefficients A, B and C are determined $$0.066\leqq A\leqq 0.120$$

$$0.342\leqq B\leqq 0.709$$

$$-7.611\leqq C\leqq -4.776$$

According to the thirteenth aspect, an image forming apparatus is provided to relieve an uncomfortable feeling in a relatively fast running image forming apparatus. In the apparatus, a discomfort index, S, calculated with the following sound quality evaluative equation (e), using a sound pressure level (A characteristic) and, a sharpness value or a psychoacoustic parameter obtained from the sound from the image forming apparatus at a location apart a certain distance from an end of the image forming apparatus, satisfies $S<-0.448$.

A fourteenth aspect of the present invention provides the image forming apparatus according to the thirteenth aspect, wherein the coefficients are determined $A=0.093$, $B=0.525$ and $C=-6.194$.

A fifteenth aspect of the present invention provides the image forming apparatus according to the thirteenth aspect, wherein the psychoacoustic parameters, obtained from the sound from the image forming apparatus at a location apart a certain distance from an end of the image forming apparatus, satisfy conditions including a loudness value $\leqq 9.00$ (sone), a tonality value $\leqq 0.08$ (tu), a roughness value $\leqq 1.65$ (asper), a relative approach $\leqq 0.32$ and an impulsiveness $\leqq 0.48$ (iu).

A sixteenth aspect of the present invention provides the image forming apparatus according to the thirteenth aspect, at least comprising, a paper conveying unit which conveys a recording paper, the paper conveying unit including a guide member for guiding the recording paper, the guide member composed of a flexible sheet, the flexible sheet having a tip roundly folded for contacting with the recording paper.

According to the sixteenth aspect, the guide member is composed of a flexible sheet and has a tip that is roundly folded for contacting with the recording paper, thereby reducing a slipping sound caused from the recording paper and the guide member to reduce a paper conveying sound and relieve the uncomfortable feeling.

A seventeenth aspect of the present invention provides the image forming apparatus according to the thirteenth aspect, at least comprising, a paper conveying unit which conveys a recording paper, the paper conveying unit including a guide member for guiding the recording paper, the guide member composed of a flexible sheet, the flexible sheet having a contact portion bent at an end for contacting with the recording paper.

According to the seventeenth aspect, the guide member is composed of a flexible sheet and has a contact portion that is bent at an end for contacting with the recording paper, thereby reducing a slipping sound caused from the recording paper and the guide member to reduce a paper conveying sound and relieve the uncomfortable feeling.

An eighteenth aspect of the present invention provides the image forming apparatus according to the second or thirteenth aspect, wherein the certain distance is determined as $1.00\pm0.03$.

Other objects and features of this invention will become understood from the following description with reference to the accompanying drawings.

DETAILED DESCRIPTIONS

With reference to the accompanying drawings, preferred embodiments of an image forming apparatus and method of evaluating sound quality on image forming apparatus according to the present invention will be described in detail in an order of the first embodiment and the second embodiment below. The first embodiment describes an image forming apparatus that runs at a relatively slow (a low-speed machine) . The second embodiment describes an image forming apparatus that runs at a relatively fast (a medium-speed machine).

In relation to the image forming apparatus according to the first embodiment, "Arrangement of Image forming apparatus", "Derivation of Sound quality evaluative equation for Image forming apparatus", and "Measures for reducing Uncomfortable sounds from Image forming apparatus" are described in turn.

(Arrangement of Image Forming Apparatus)

Figure 1:
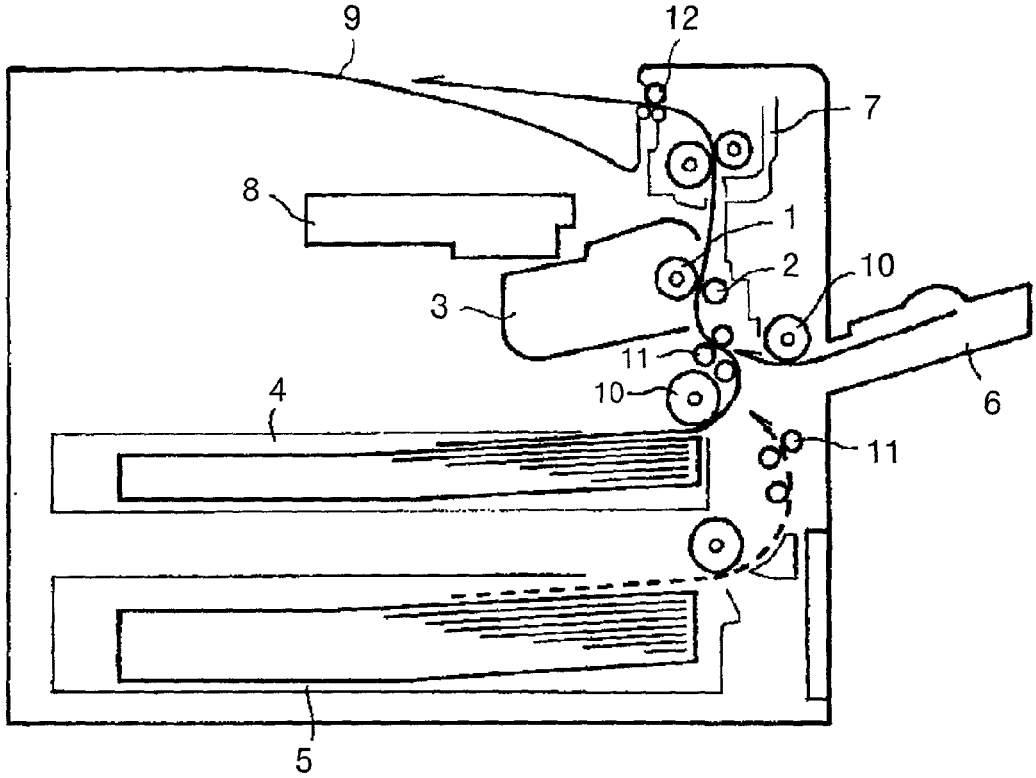
FIG. 1 is a view of the essential part in an arrangement for illustrating an example of an image forming apparatus according to a first embodiment.

FIG. 1 is a view of the essential part of an arrangement for illustrating an example of an image forming apparatus according to the first embodiment. The image forming apparatus shown in FIG. 1 comprises an image carrier or photosensitive drum 1, a transfer roller 2 for transferring a toner image formed on the photosensitive drum 1 to a recording paper, a process cartridge 3 for forming a toner image on the photosensitive drum 1, a main tray 4, a bank feed tray 5, a manual feed tray 6, a fixing unit 7, a writing unit 8 for writing an image on the photosensitive drum 1, an eject tray 9, a feed roller 10, and a pair of resist rollers 11.

The image forming apparatus shown in FIG. 1 is provided with a paper conveying system that includes the main tray 4, the bank feed tray 5, the manual feed tray 6, the feed roller 10 and the resist rollers 11. A recording paper is conveyed from the paper conveying system to the eject tray 9 through the process cartridge 3 and via the fixing unit 7 and an eject roller 12.

The image writing unit 8, located above the process cartridge 3, includes a LD unit, a polygon mirror, an fθ mirror (not shown) and so forth. In addition, there are provided the photosensitive drum 1, a drive motor for rotationally driving rollers, and a drive transmission system that includes solenoids and clutches (not shown). Thus configured image forming apparatus radiates, at the time of forming images, driving sounds from the drive motor and the drive transmission system, operation sounds from the solenoids and clutches, paper conveying sounds and charging sounds.

Figure 2:
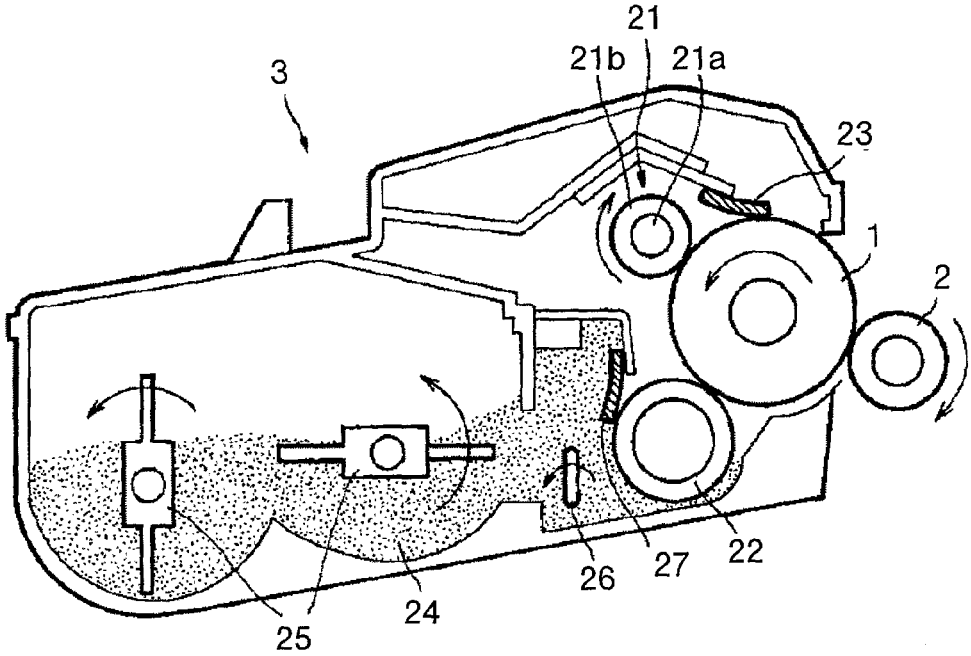
FIG. 2 is a cross-sectional view of the essential part for illustrating an example of a process cartridge shown in FIG. 1.

FIG. 2 is a cross-sectional view of the essential part for illustrating an example of the process cartridge 3 shown in FIG. 1. The process cartridge 3 shown in FIG. 2 comprises a charging unit or charging roller 21, a developing unit or developing roller 22, a cleaning unit or cleaning blade 23, toner 24, an agitator 25, an agitating rod 26 and a developing blade 27.

Around the image carrier or photosensitive drum 1, the charging unit or charging roller 21, the developing unit or developing roller 22 and the cleaning unit or cleaning blade 23 are located. The toner 24 in the process cartridge 3 is agitated and conveyed to the developing roller 22 by the agitator 25 and the agitating rod 26. The toner 24 magnetically attached to the developing roller 22 is frictionally charged negative on passing over the developing blade 27. The negatively charged toner 24 is transferred to the photosensitive drum 1 in the presence of a bias voltage and is attracted onto an electrostatic latent image.

When a recording paper, passed through the resist rollers 11, passes in between the photosensitive drum 1 and the transfer roller 2, a toner image on the photosensitive drum 1 is transferred therefrom to the recording paper due to positive charges on the transfer roller 2. Residual toner stayed on the photosensitive drum 1 is scraped off by the cleaning blade 23 and collected, as waste toner, in a tank located above the cleaning blade 23. Other parts than the transfer roller 2 are integrated in the process cartridge 3, which allows the user to replace it easily.

Figure 3:
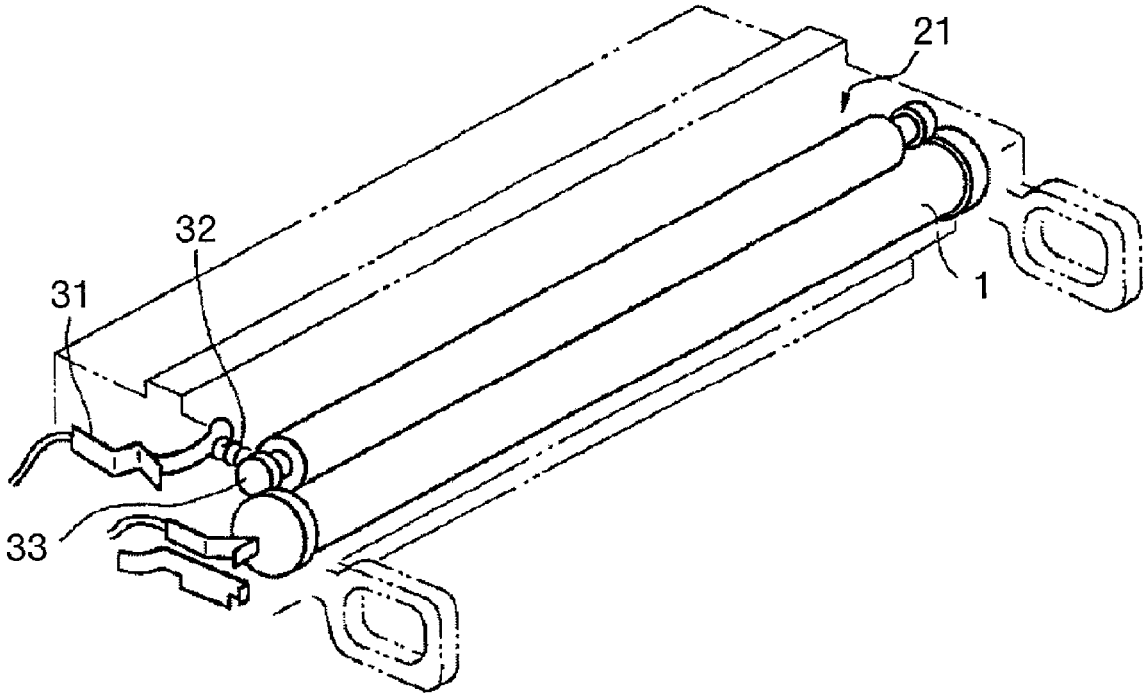
FIG. 3 is a perspective view of the essential part for illustrating an example of a charging roller shown in FIGS. 1 and 2.

FIG. 3 is a perspective view of the essential part for illustrating an example of the charging roller 21 shown in FIG. 2. As shown in FIGS. 2 and 3, the charging roller 21 is such a member that always contacts the photosensitive drum 1 and rotationally follows it with a frictional force so as to primarily charge the outer surface of the photosensitive drum 1 uniformly. As shown in FIG. 2, the charging roller 21 comprises a central shaft 21*a* and a charging part 21*b* concentrically formed around the shaft 21*a*.

A bias voltage consisting of a DC voltage and an AC voltage superimposed thereon is applied to the charging roller 21, during a charging operation, from a high-voltage power supply via an electrode pad 31, a charging roller press spring 32 and a conductive bearing 33. The charging roller 21 can charge the photosensitive drum 1 uniformly to the same voltage as the DC component in the bias voltage. The AC component in the bias voltage serves to charge the photosensitive drum 1 from the charging roller 21 uniformly without variations.

The following description is directed to a proper value for a frequency of the AC component that does not produce variations in an image. Generally, as the number of prints per minute (hereinafter referred to as "ppm") increases, the AC component is required to have a higher frequency. Specifically, if the number of copies per minute is equal to 16 ppm or more, it is desirable that the frequency of the AC component has a proper value of 1000 Hz or more. In the case of a machine with a less ppm than that in the above case, it is not required to set such a higher frequency as the above case.

When the charging roller 21 is employed to contact and charge the photosensitive drum 1, attractive and repulsive forces act alternately between the surface of the charging roller 21 and the surface of the photosensitive drum 1 in general and cause vibrations on the charging roller 21. This is due to the AC component in the bias voltage. The vibrations of the charging roller 21 lead to a noisy, high-frequency vibrating sound (charging sound) on the charging roller 21 itself. In addition, the sound is transmitted to the photosensitive drum 1 and vibrates the photosensitive drum 1, resulting in noises.

The charging sound generally includes a frequency of the AC component and its integer-multiplied harmonics. If the AC component has a fundamental frequency of 1000 Hz, charging sounds maybe caused as the second harmonics 2000 Hz, the third harmonics 3000 Hz and so forth while the higher a degree of harmonics the lower a sound pressure level. If an image forming apparatus causes vibrations, a frequency below 200 Hz appears as a banding on an image and a frequency equal to or more than 200 Hz can be well heard as a sound. Acoustically, the frequency below 200 Hz is not very troublesome because an acoustic sensitivity worsens for such the frequency. Accordingly, with respect to the charging sound, it is sufficient to consider only the cases of the AC component that has frequencies equal to or more than 200 Hz at the time of charging.

Figure 4:
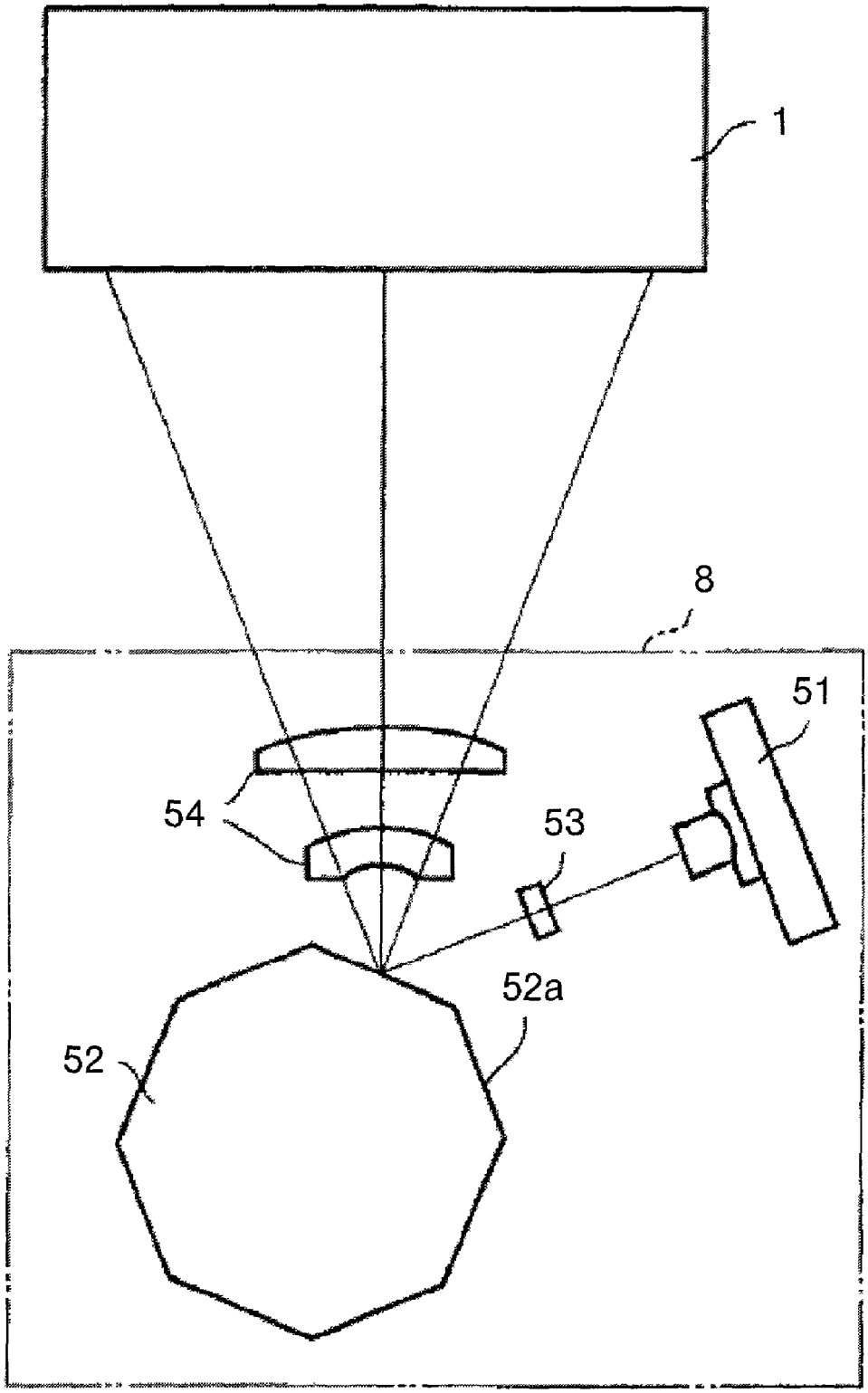
FIG. 4 is a view of the essential part in an arrangement for illustrating an example of a writing unit shown in FIG. 1.
Figure 5:
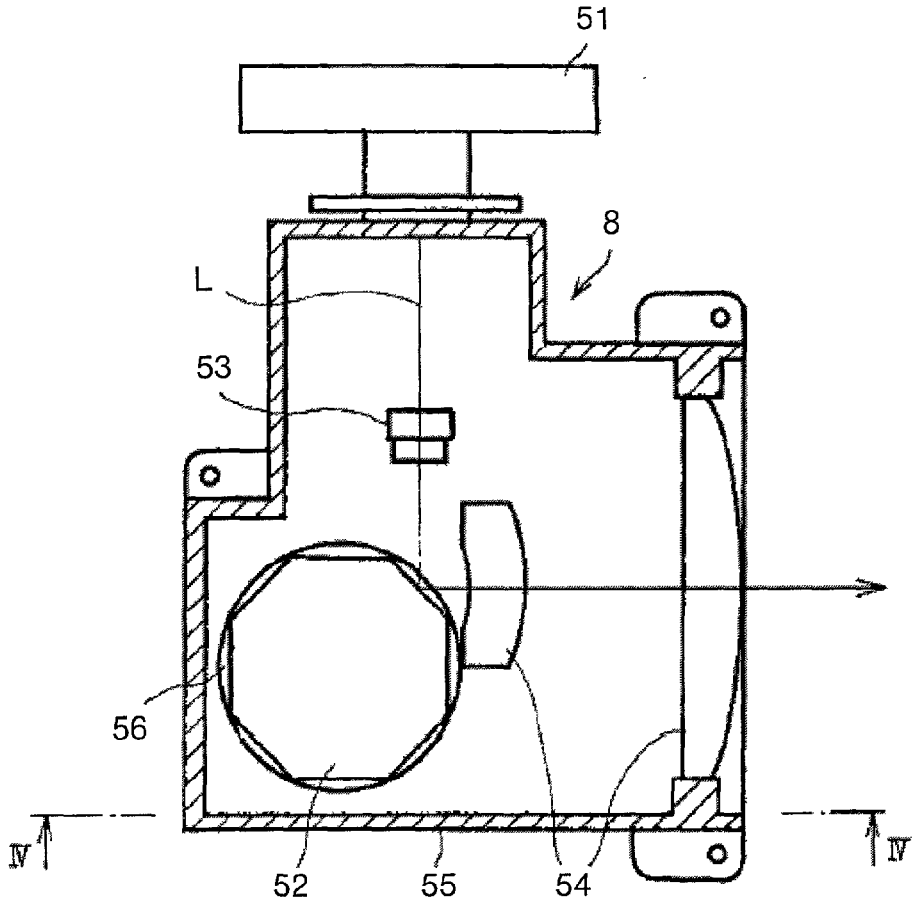
FIG. 5 is a view of the essential part in an arrangement for illustrating an example of a writing unit shown in FIG. 1.
Figure 6:
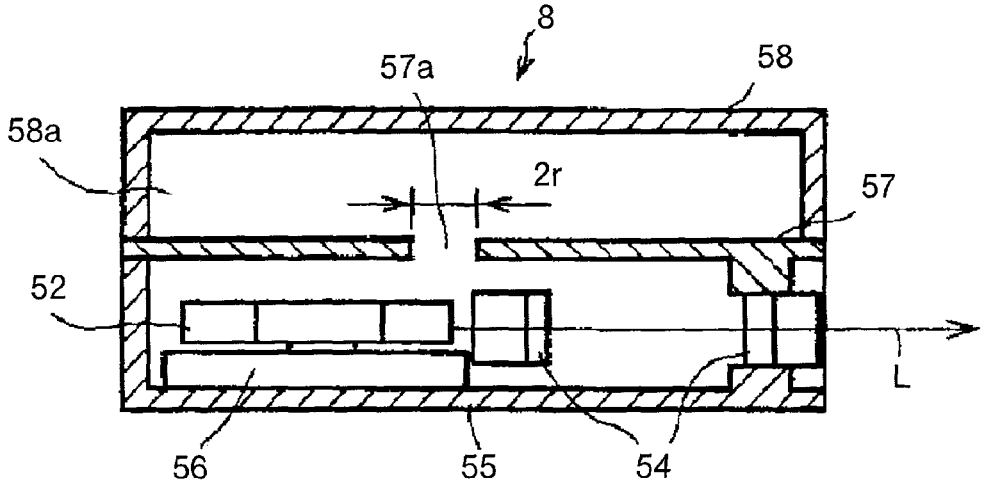
FIG. 6 is a view of the essential part in an arrangement for illustrating an example of a writing unit shown in FIG. 1.

FIGS. 4 to 6 are views of the essential part of an arrangement for illustrating an example of the writing unit 8 in FIG. 1. FIG. 4 is a view of an outlined arrangement of the writing unit 8 in FIG. 1. FIG. 5 is a view of a specified arrangement of the writing unit in FIG. 1. FIG. 6 is a diagram viewed along the IV to IV arrow in FIG. 5.

In the writing unit 8 shown in FIG. 4, a laser emission unit 51 is employed to emit a laser beam. A polygon mirror 52 rotates at a high-rate of 20000 rpm or more to scan the laser beam on the photosensitive drum 1 in the longitudinal direction (the main scan direction). A toric lens 53 is interposed between the laser emission unit 51 and the polygon mirror 52 to adjust a spot diameter of the laser beam into a certain size.

A lens system 54 is interposed between the polygon mirror 52 and the photosensitive drum 1 to focus the scanning spot with a certain-sized diameter on the photosensitive drum 1. The lens system 54 may be of a type that has only an fθ characteristic. Alternatively, it may be of a type that employs the polygon mirror 52 and the photosensitive drum 1 in a conjugate relation to achieve a function of tilt correction for a reflective surface 52*a* of the polygon mirror 52 as well as an fθ characteristic.

As shown in FIG. 5, the reference numeral 55 denotes a housing in the form of a box, which contains the toric lens 53, the lens system 54, a motor 56 and the polygon mirror 52 integrated with the motor 56 therein. Further, as shown in FIG. 6, a lid 57 is mounted via a packing member on the housing 55 for preventing dust and dirt from attaching on the polygon mirror 52. The lid 57 serves to retain the inside of the housing 55 almost airtight in consideration of preventing dust and dirt from entering inside. A sound absorbent box 58 is provided above the lid 57 to form, inside the sound absorbent box 58, an airtight sound absorbent chamber 58*a* that is shut out from external. A communication hole 57*a* is formed in the lid 57 to communicate the inside of the housing 55 with the sound absorbent chamber 58*a*.

In the writing unit 8 thus configured, the laser beam emitted from the laser emission unit 51 is shaped through the toric lens 53 to have a certain-sized spot diameter. The laser beam with the certain-sized spot diameter is scanned at each reflective surface 52*a* on the polygon mirror 52 that is rotationally driven by the motor 56. The scanned laser beam is focused through the lens system 54 on the photosensitive drum 1 so that the scanning spot diameter has a certain size. Such the lens system 54 demonstrates an fθ characteristic to equalize a velocity at each position when the laser beam scans on the photosensitive drum 1.

(Derivation of Sound Quality Evaluative Equation for Image Forming Apparatus)

Combining and weighting psychoacoustic parameters that greatly effect on uncomfortable sounds from the relatively low-speed image forming apparatus, the inventors have successfully derived a sound quality evaluative equation for assuming a subjective evaluation value of sound quality, that is, an objective, sound quality evaluative equation. The inventors have also successfully proposed, in the sound quality evaluative equation derived, a condition that gives no uncomfortable feeling. The derivation of the sound quality evaluative equation for the image forming apparatus and the condition that gives no uncomfortable feeling will be described below.

Figure 7:
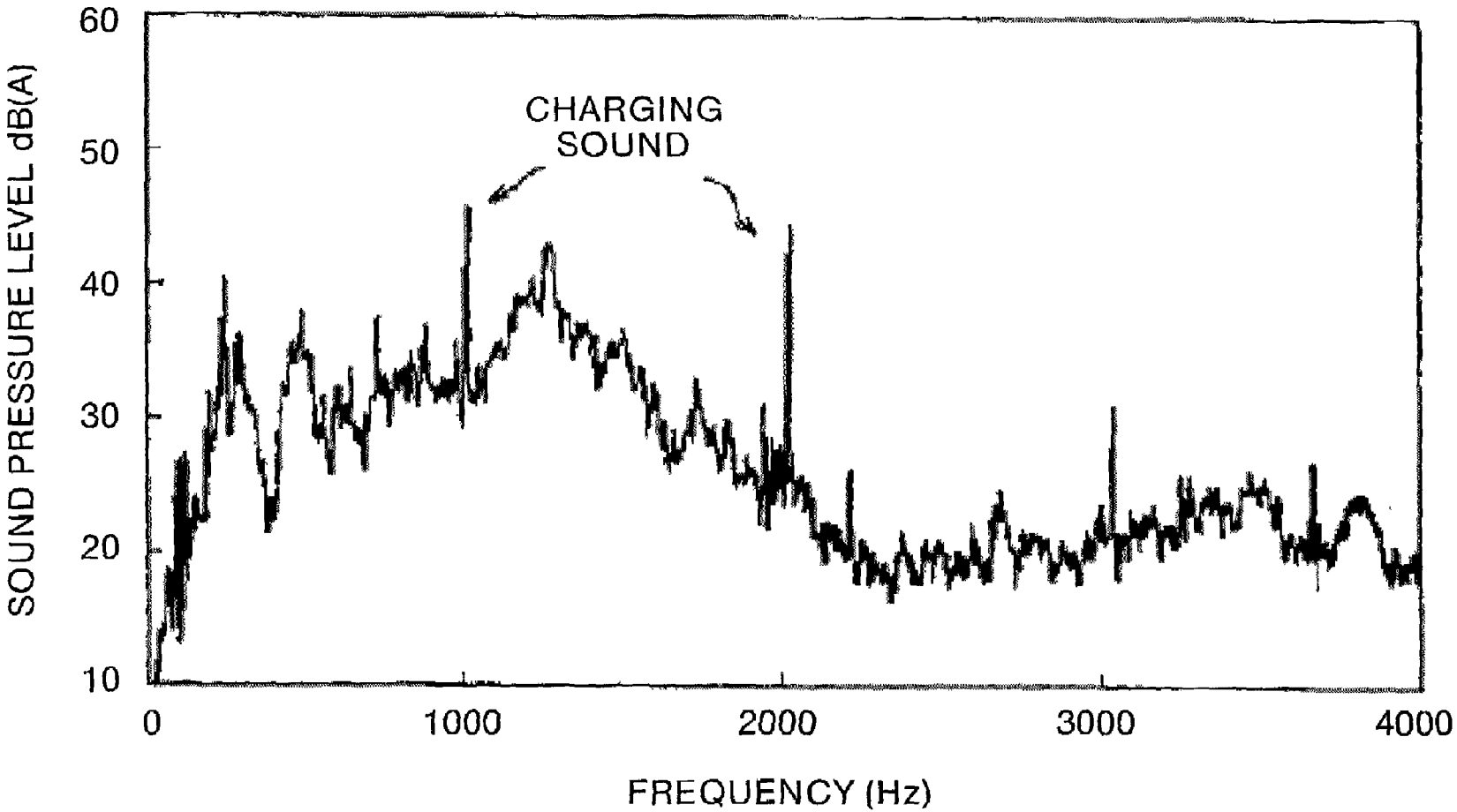
FIG. 7 is a graph for showing an example of a result from a frequency analysis to noises from the image forming apparatus in FIG. 1.

FIG. 7 is a graph for showing an example of a result from a frequency analysis to noises from the image forming apparatus. In the figure, the lateral axis indicates frequencies (Hz) and the longitudinal axis sound pressure levels, dB. The graph shown in the figure is mainly purposed to examine a distribution of frequencies. Accordingly, a relative comparison between sound pressure levels at respective frequencies is meaningful while an absolute comparison between sound pressure levels is meaningless because accurate calibration is not performed. In the figure, abrupt peaks at 1 kHz and 2 kHz are called charging sounds as described earlier.

As shown in FIG. 7, the charging sound has a sound pressure level higher by 10 dB or more than other surrounding frequencies. Such a high-level pure sound, though it has a very smaller amount energetically compared to the whole, can not be masked with other sounds and can be heard as an uncomfortable sound clearly.

When a degree of discomfort is objectively evaluated on a mechanical sound, a standard for measuring the degree of discomfort is required. A noise meter is employed to evaluate energy of a sound. Similar to this case, it is required to measure some physical amounts of a sound, assigning the values of the physical amounts into a sound quality evaluative equation, and evaluating the degree of discomfort from the computed values.

The inventors implemented experiments for subjective evaluation on humans and performed a statistic analysis using plural psychoacoustic parameters to create a sound quality evaluative equation for predicting a degree of discomfort of a sound. This sound quality evaluative equation must be statistically significant as high as 95% or more. The psychoacoustic parameters used include the above-mentioned tonality, sharpness, roughness, fluctuation strength and so forth.

Examples of tests for subjective evaluation on uncomfortable sounds implemented by the inventors are described. The subjective evaluation tests on uncomfortable sounds are implemented in the following procedures, (1) Collection of running sounds from Image forming apparatus, (2) Processing of the running sounds (Production of plural processed sounds (Sample sounds)), (3) Measurement of psychoacoustic parameters from the produced sample sounds, (4) Experiments on sample sounds by paired comparisons→Computation of subjective evaluation values against uncomfortable sounds, and (5) Multiple regression analysis based on subjective evaluation values against uncomfortable sounds and measured values of psychoacoustic parameters→Derivation of a sound quality evaluative equation.

Each step is specifically described below.

(1) Collection of Running Sounds from Image Forming Apparatus,

To collect running sounds, three different types of image forming apparatus, A-machine (20 ppm), B-machine (16 ppm) and C- machine (16 ppm), were prepared. The running sounds from these three different image forming apparatus were respectively collected by a dummy head, HMS (head Measurement System), available from Head Acoustics Inc., under the following measurement conditions and binaurally recorded through a digital audio tape (hereinafter referred to as DAT). Thus recorded sounds can be reproduced through a special headphone that replays them feelingly as if a person actually listens to the mechanical sounds.

[Measurement Conditions]

Recording environment, Semi-anechoic chamber (with a standard table)

Location of ears in the dummy head, A height of 1.2 m and a horizontal distance of 1 m from a machine end Recording mode, FF (free field→for anechoic chamber)

HP filter, 22 Hz (4) Experiments on Sample Sounds by Scheff's Method of Paired Comparisons (Ura's Modified Method)→Computation of Subjective Evaluation Values Against Uncomfortable Sounds, Subjects for evaluating sample sounds were gathered to compare paired sample sounds with each other and determine which one was felt uncomfortable. Ura's modified method is the following method of paired comparisons. Taking a comparison order into consideration, one subject compares all combinations once. Specifically, combinations each including two samples are created from n-samples, and N-subjects compare (i, j) with (j, i) in all combinations, thereby obtaining subjective evaluation values on sample sounds and ordering them. For example, in comparison of the sample sound 1 with the sample sound 2 (on abase of the sample sound 1), a subjective evaluation value on the sample sound 1 is calculated to get 1 point if the sample sound 1 is felt uncomfortable and −1 point if the sample sound 2 is felt uncomfortable. Results were totaled and statistically processed, resulting in a subjective evaluation value, $\alpha$, obtained on each sample sound ($-1 \leqq \alpha \leqq 1$). The larger the subjective evaluation value $\alpha$, the more the sound is felt uncomfortable. Table 1 shows subjective evaluation values, $\alpha$, on every sample sound. Table 1 shows subjective evaluation values $\alpha$ on sample sounds and measured values of psychoacoustic parameters.

TABLE 1

SUBJECTIVE EVALUATION VALUES ON SAMPLE SOUNDS AND MEASURED VALUES OF PSYCHOACOUSTIC PARAMETERS

| SAMPLE SOUND | SUBJECTIVE EVALUATION VALUE $\alpha$ | LOUDNESS (sone) | TONALITY (tu) | SHARPNESS (acum) | ROUGHNESS (asper) | FLUCTUATION STRENGTH (vacil) |
|---|---|---|---|---|---|---|
| 1 | −0.0968 | 8.1 | 0.13 | 2.4 | 0.8 | 1.01 |
| 2 | 0.6953 | 9.9 | 0.20 | 2.5 | 1.11 | 1.24 |
| 3 | −0.7957 | 6.9 | 0.09 | 2.3 | 0.32 | 0.91 |
| 4 | 0.5627 | 10.3 | 0.15 | 2.4 | 1.24 | 1.12 |
| 5 | 0.2939 | 8.8 | 0.22 | 2.1 | 0.54 | 1.03 |
| 6 | −0.0036 | 9.0 | 0.11 | 2.3 | 1.00 | 1.11 |
| 7 | −0.3584 | 7.4 | 0.12 | 2.5 | 0.51 | 0.98 |
| 8 | 0.0609 | 8.0 | 0.21 | 2.5 | 0.63 | 0.99 |
| 9 | −0.3584 | 8.0 | 0.08 | 2.7 | 0.96 | 1.12 |
| B-MACHINE | −0.6604 | 7.4 | 0.06 | 2.6 | 0.61 | 1.31 |
| C-MACHINE | −0.1957 | 7.7 | 0.21 | 2.7 | 0.61 | 1.25 |

(2) Processing of Running Sounds (Production of Plural Processed Sounds (Sample Sounds)), A running sound from A-machine was processed using an acoustic analyzer, BAS (Binaural Analysis System), available from Head Acoustics Inc. Sample sounds 1 to 9 were produced using a method of processing running sounds, which removes from a recorded running sound a part, on a frequency axis or on a time axis, associated with each sound source in the image forming apparatus. Alternatively, the method emphasizes sound pressure levels. The sample sound 1 is an original sound from A-machine.

(3) Measurement of Psychoacoustic Parameters in the Produced Sample Sounds,

The sounds processed from the running sound from A-machine (nine sounds) and the running sounds from B- and C-machines were subjected as sample sounds to measurement of psychoacoustic parameter values using the acoustic analyzer, BAS, Head Acoustics Inc. Measured results on the sample sounds and psychoacoustic parameters are shown in Table 1.

Among psychoacoustic parameters, only the loudness is standardized in ISO 532B. As for other psychoacoustic parameters, the same fundamental concept can be applied, however, programs and computations are different from one another due to a unique research according to each measurement instrument maker. In this experiment, the dummy head HMS III and the acoustic analyzer BAS, both available from Head Acoustics Inc., were employed particularly.

(5) Multiple Regression Analysis Based on Subjective Evaluation Values Against Uncomfortable Sounds and Measured Values of Psychoacoustic Parameters→Derivation of a Sound Quality Evaluative Equation, A multiple regression analysis is effective to accurately predict a subjective evaluation value (a target variable) from a plurality of psychoacoustic parameters (a group of explanatory variables). A single regression analysis predicts a target variable from a single explanatory variable, which may often lack accuracy. Therefore, the multiple regression analysis is more effective because it predicts a target variable from a combination of plural explanatory variables.

The multiple regression analysis is a method of deriving an accurate predictive equation utilizing a sum relation (linear combination) of explanatory variables and using explanatory variables as less as possible. The explanatory variables are employed plural but as less as possible because it is intended to minimize measurements of psychoacoustic parameter values. In addition, it is unreasonable to introduce psychoacoustic parameters, which are meaningless and unrelated to a subjective evaluation value (uncomfortable feeling), into the predictive equation.

An actual multiple regression analysis can be executed using commercially available spreadsheet software or statistic analysis software. For example, a regression analysis or analysis tool in "Excel® (Microsoft Inc.)", and statistic analysis software, "JMP® (SAS Institute Inc.)" or "SPSS® (SPSS Inc.)" can be employed. Once data in Table 1 (Subjective evaluation values α and measured values of psychoacoustic parameters) are entered into "Excel" or "JMP", implementation of the analysis along with selection of explanatory variables can output statistical results such as regression coefficients, P-values of the selected explanatory variables and contribution rates of the equation. The P-value indicates a probability in a significant difference assay for determining significant if it is equal to or below 5% and insignificant (unrelated) if it exceeds 5%.

First, a single regression analysis is previously executed with subjective evaluation values (uncomfortable feeling) α and a group of psychoacoustic parameters to examine which psychoacoustic parameter has a large relation with a subjective evaluation value α. This allows variables for use in a multiple regression analysis to be selected easily. It was found as a result of the variable selection that the subjective evaluation value α can be predicted precisely if the loudness (magnitude of audibility) and tonality (contents of pure sound components) are selected. It was also found that other psychoacoustic parameters are meaningless (insignificant) even if they are assigned into the predictive equation (sound quality evaluative equation).

Table 2 shows assumed values of regression coefficients obtained from a multiple regression analysis executed to the subjective evaluation value α and the loudness and tonality in Table 1. Table 2 shows part of outputs from the analysis by "Excel". The regression coefficients are selected from within a 95% reliable zone. The segment, loudness and tonality are highly significant if the P-value is equal to or below 0.05. In a combination of loudness and tonality, a contribution rate $R^2$ to the subjective evaluation value α was 97%. This means that the loudness and tonality contribute to 97% discomfort of a sound. The rest 3% discomfort is felt from other factors.

The results in Table 2 were employed to derive the following sound quality evaluative equation (a) for predicting a subjective evaluation value α from psychoacoustic parameters (loudness and tonality) . The sound quality evaluative equation (a) yields a predicted value of the subjective evaluation value α, which is called a "discomfort index S". This discomfort index S has no unit. The sound quality evaluative equation could predict sounds not from only A-machine but also B- and C-machines of different types. Accordingly, the equation can be held generally for a plurality of image forming apparatus (machines) with about 16 to 22 ppm.

$$S=A\times(\text{Loudness value})+B\times(\text{Tonality value})+C \quad \text{(a)}$$

where A, B and C denote multiple regression coefficients and show ranges in the cases of 95% reliable zones, $$0.247\leqq A\leqq 0.380$$

$$2.075\leqq B\leqq 4.890$$

$$-3.649\leqq C\leqq -2.643$$

If the above multiple regression coefficients A, B and C are employed as averages within the ranges (the regression coefficients shown in Table 2), the discomfort index S can be represented by the following sound quality evaluative equation (b), $$S=0.3135\times(\text{Loudness value})$$

$$+3.4824\times(\text{Tonality value})$$

$$-3.1460\ (-1\leqq S\leqq 1) \quad \text{(b)}$$

It was found that discomfort of noises from image forming apparatus of 16 to 22 ppm classes could be represented by the loudness (magnitude of audibility) and tonality (content of pure sound components). It was also found that the charging sound was uncomfortable in the image forming apparatus having frequency components as shown in FIG. 6.

According to the sound quality evaluative equations (a) and (b), other psychoacoustic parameters are unrelated to the discomfort or other psychoacoustic parameters can effect on the discomfort through the loudness and tonality. Even the psychoacoustic parameter currently unrelated to discomfort, if it has a value larger than the current state, may possibly effect on the discomfort. Even the psychoacoustic parameter currently related to discomfort through the loudness and tonality, if it has a value larger than the current state, may possibly turn into the most discomfort psychoacoustic parameter effecting on the discomfort as replacement of the loudness and tonality. Accordingly, it can be concluded from

TABLE 2

RESULTS FROM MULTIPLE REGRESSION ANALYSIS

| | REGRESSION COEFFICIENT | STANDARD ERROR | t | P-VALUE | LOWER LIMIT 95% | UPPER LIMIT 95% |
|---|---|---|---|---|---|---|
| SEGMENT | −3.14595 | 0.2057047 | −15.2935 | 4.936E−06 | −3.6492869 | −2.6426036 |
| LOUDNESS | 0.313505 | 0.0270799 | 11.57704 | 2.499E−05 | 0.247242903 | 0.37976722 |
| TONALITY | 3.482429 | 0.575201 | 6.054281 | 0.00091997 | 2.074961461 | 4.88989603 |

Figure 8:
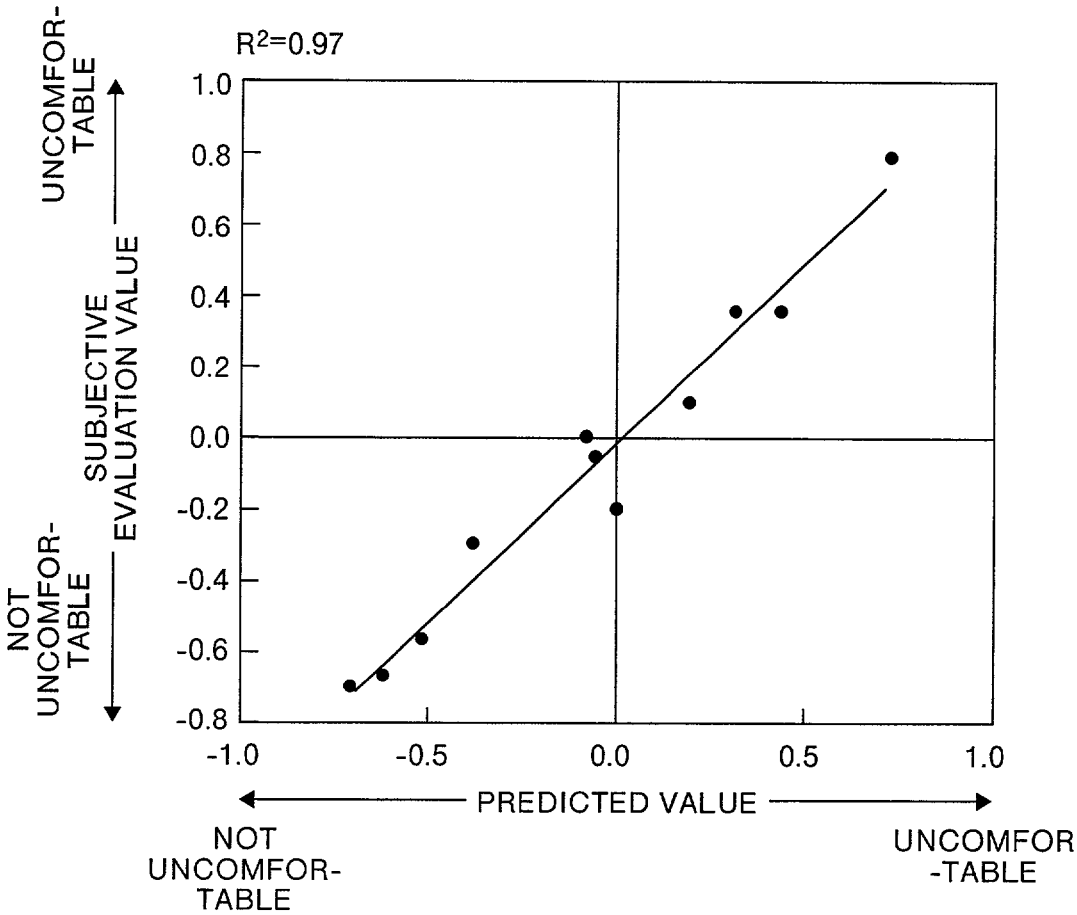
FIG. 8 is a distribution view which plots relations between a subjective evaluation value $\alpha$ and a discomfort index S (a predicted value by a sound quality evaluative equation)

Table 1 that the sound quality evaluative equations (a) and (b) can be held within the ranges that satisfy the following conditions, Sharpness of 2.70 (acum) or below Roughness of 1.24 (asper) or below Fluctuation strength of 1.31 or below FIG. 8 is a distribution view plotting relations between a subjective evaluation value $\alpha$ and a discomfort index S (a value predicted by the sound quality evaluative equation (b)). As shown in the figure, there is a good correlation between the subjective evaluation value $\alpha$ resulted from a subjective evaluation experiment on human and the discomfort index S. The use of the sound quality evaluative equation (b) allows the sound quality to be evaluated on discomfort objectively.

Table 3 collectively shows results from experiments on the discomfort index S, which indicate a certain degree of the discomfort index S that is required to eliminate discomfort. Subjects are directed to hearing of the sample sounds 1 to 17 obtained by processing the running sound from A-machine and of the running sounds from B- and C-machines to evaluate them on discomfort in three stages. In Table 3, the mark "○" indicates a sound evaluated good, "x" a sound evaluated bad, and "Δ" a sound evaluated medium.

TABLE 3

RESULTS FROM ABSOLUTE EVALUATION ON SOUNDS

| SAMPLE SOUND | S-VALUE | EVALUATION |
|---|---|---|
| 2 | 0.639 | X |
| 4 | 0.588 | X |
| 5 | 0.362 | X |
| 10 | 0.346 | X |
| 13 | 0.182 | X |
| 12 | 0.177 | X |
| 8 | 0.06 | Δ |
| 6 | 0.059 | Δ |
| C-MACHINE | −0.001 | Δ |
| 14 | −0.075 | Δ |
| 16 | −0.089 | Δ |
| 1 | −0.187 | Δ |
| 17 | −0.347 | Δ |
| 9 | −0.392 | Δ |
| 15 | −0.408 | Δ |
| 7 | −0.426 | Δ |
| 19 | −0.455 | Δ |
| 18 | −0.500 | ○ |
| 11 | −0.614 | ○ |
| B-MACHINE | −0.617 | ○ |
| 3 | −0.702 | ○ |

In accordance with the results in Table 3, if a condition, $S<-0.5$ . . . (c), can be satisfied, an uncomfortable feeling is relieved. Determination of the loudness and tonality values in the sound quality evaluative equation (b) so as to satisfy the condition (c) can provide an image forming apparatus that has a relieved uncomfortable feeling.

If a condition, $S<-0.7$ . . . (d), can be satisfied, it is possible to provide an image forming apparatus that causes a sound with discomfort hardly felt.

(Methods of Reducing Uncomfortable Sounds from Image Forming Apparatus)

In order to satisfy the above condition (c) in the sound quality evaluative equation (b), it is required to reduce charging sounds caused from the charging roller 21 and noises caused from the writing unit 8 in the image forming apparatus in FIG. 1. Such reduction methods will be described in an order of [Charging sound reduction method 1], [Charging sound reduction method 2], [Charging sound reduction method 3], [Charging sound reduction method 4], and [Noise reduction method applied to noises caused from the writing unit].

[Charging Sound Reduction Method 1]

The charging sound reduction method 1 comprises press-fitting a high-stiffness, cylindrical member into the image carrier. This member shifts the eigenfrequency of the image carrier to a frequency different from a frequency obtained by multiplying an AC-bias frequency f on the charging roller 21 by a natural number to reduce the charging sounds.

If vibrations caused between the charging roller 21 and the photosensitive drum 1 have a frequency that is coincident with or in the vicinity of a frequency obtained by multiplying the eigenfrequency fd of the photosensitive drum 1 itself by a natural number, the photosensitive drum 1 establishes resonance. This resonance leads to a sharp increase in a sound pressure level of the charging sound, resulting in a sharp elevation in the discomfort index S. If the eigenfrequency fd of the photosensitive drum 1 is previously set to a frequency different from a frequency obtained by multiplying an AC-bias frequency f on charging by a natural number, the photosensitive drum 1 can be prevented from resonating and the charging sound can be reduced. For instance, in the example shown in FIG. 6, a frequency obtained by multiplying 1000 Hz by a natural number is selected so as not to be coincident with the eigenfrequency fd of the photosensitive drum 1.

Figure 9:
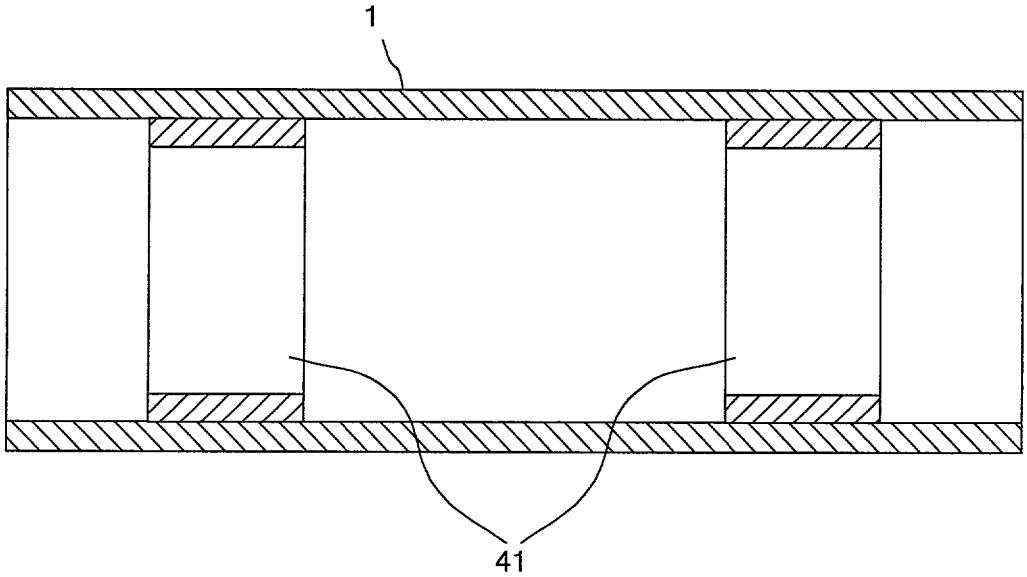
FIG. 9 is a cross-sectional view of the essential part for illustrating an embodiment to shift the eigenfrequency of a photosensitive drum.

FIG. 9 is a cross-sectional view of the essential part for illustrating an embodiment to shift the eigenfrequency of a photosensitive drum. In this figure, high-stiffness cylindrical members 41 are press-fitted in the photosensitive drum 1. When the cylindrical members 41 are press-fitted, the photosensitive drum 1 increases its weight and stiffness and, accordingly changes its eigenfrequency. As a result, uncomfortable charging sounds due to the resonance can be avoided even if the photosensitive drum 1 have an eigenfrequency fd that is coincident with or in the vicinity of a frequency obtained by multiplying an AC-bias frequency f by a natural number. Because the eigenfrequency fd of the photosensitive drum 1 can be changed.

[Charging Sound Reduction Method 2]

In the charging sound reduction method 2, a sound absorber is provided inside the image carrier. This absorber shifts the eigenfrequency of the image carrier to a frequency different from a frequency obtained by multiplying an AC-bias frequency f on the charging roller 21 by a natural number to reduce the charging sounds.

Figure 10A:
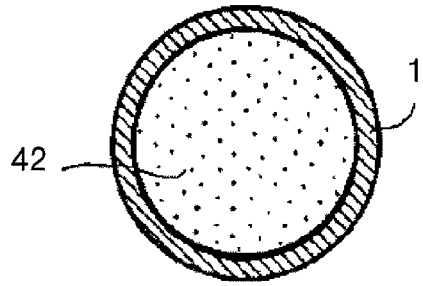
FIG. 10 is a cross-sectional view of the essential part for illustrating another embodiment to shift the eigenfrequency of a photosensitive drum.
Figure 10B:
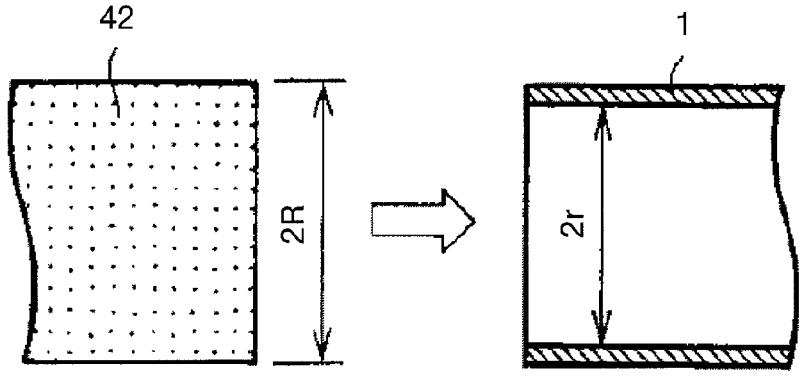

FIG. 10 is a cross-sectional view of the essential part for illustrating another embodiment to shift the eigenfrequency of a photosensitive drum. FIG. 10A is a cross-sectional view of the photosensitive drum 1, into which a sound absorber 42 is press-fitted. FIG. 10B is a cross-sectional side view of the sound absorber 42 and the photosensitive drum 1.

As shown in FIG. 10B, a columnar sound absorber 42 is prepared. It has a diameter, 2R, a size larger than the inner diameter, 2*r*, of the photosensitive drum 1. If the sound absorber 42 is composed of foamed polyurethane, it is convenient for handling. For example, a sound absorbent material, HAMA-DAMPER HU-4, available from Yokohama Rubber may be employed. This material can be elastically deformed and inserted into the photosensitive drum 1. FIG. 10A shows the sound absorber 42 in a state press-fitted into the photosensitive drum 1. The inserted sound absorber 42 expands and intends to return to the original shape not yet deformed and accordingly it is fixed in the photosensitive drum 1. The sound absorber 42 is not secured using an adhesive and the like and can be removed easily from the photosensitive drum 1. Thus, the charging sounds caused from the photosensitive drum 1 can be absorbed.

[Charging Sound Reduction Method 3]

In the charging sound reduction method 3, a damper 43 is provided inside the image carrier. This damper shifts the eigenfrequency of the image carrier to a frequency different from a frequency obtained by multiplying an AC-bias frequency f on the charging roller 21 by a natural number to reduce the charging sounds.

Figure 11:
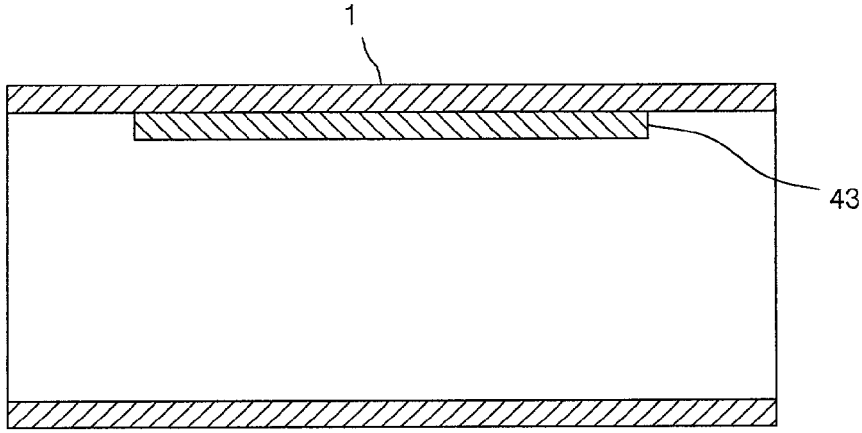
FIG. 11 is a cross-sectional view of the essential part for illustrating a further embodiment to shift the eigenfrequency of a photosensitive drum.

FIG. 11 is a cross-sectional view of the essential part for illustrating a further embodiment to shift the eigenfrequency of a photosensitive drum, showing the damper 43 in a state adhered onto the photosensitive drum 1. The damper 43 absorbs energy from the vibrating photosensitive drum 1 and converts it into thermal energy. This is effective to attenuate a vibration rate or amplitude to reduce acoustic radiation. For example, a lightweight damping material, REGETLEX, available from Nitto Denko may be employed. This material is composed of a thin aluminum substrate and a high viscous adhesive attached thereon for absorbing vibration energy. Thus, the vibration energy, generated between the charging roller 2 and the photosensitive drum 1, due to the AC bias frequency f on charging, can be absorbed so as to prevent charging sounds from occurring.

[Charging Sound Reduction Method 4]

In the charging sound reduction method 4, a DC bias is applied from the charging roller to the image carrier for charging, thereby reducing the charging sounds.

Figure 12:
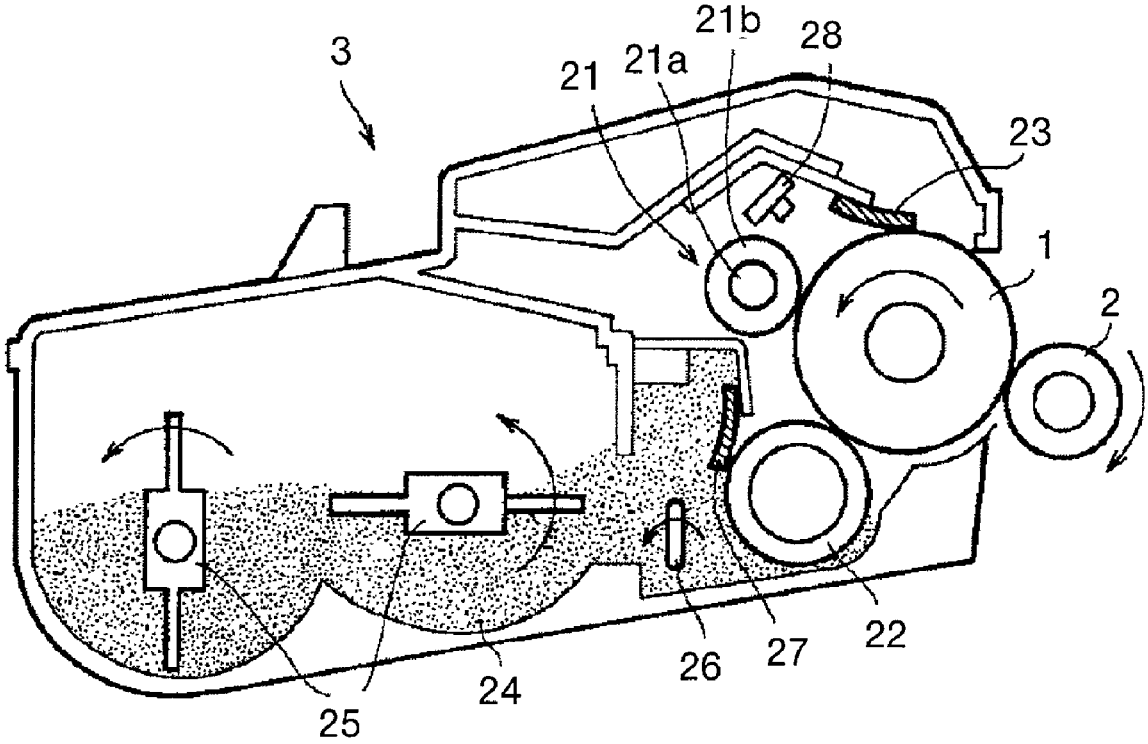
FIG. 12 is a cross-sectional view of the essential part for illustrating an embodiment of a process cartridge with a charging system of a DC charging type.

FIG. 12 is a cross-sectional view of the essential part for illustrating an embodiment of the process cartridge 8 with a charging system of a DC charging type. Around the image carrier or photosensitive drum 1, the charging unit or charging roller 21 for applying a DC bias to the photosensitive drum 1, the developing unit or developing roller 22, the cleaning unit or cleaning blade 23 and a charge eraser lamp 28 are located. The toner 24 in the process cartridge 3 is agitated and conveyed to the developing roller 22 by the agitator 25 and the agitating rod 26. The toner 24 magnetically attached to the developing roller 22 is frictionally charged negative on passing over the developing blade 27. The negatively charged toner 24 is transferred to the photosensitive drum 1 in the presence of a bias voltage and is attracted onto an electrostatic latent image.

When a recording paper, passed through the resist rollers 11, passes in between the photosensitive drum 1 and the transfer roller 2, a toner image on the photosensitive drum 1 is transferred therefrom to the recording paper due to positive charges on the transfer roller 2. Residual toner stayed on the photosensitive drum 1 is scraped off by the cleaning blade 23 and collected, as waste toner, in a tank located above the cleaning blade 23. Charge erasing is performed by the full illumination from LED to eliminate the residual potential on the photosensitive drum 1, preparing the next image formation. Other parts than the transfer roller 2 are integrated in the process cartridge 3, which allows the user to replace it easily.

When an AC bias is employed for charging, due to an AC component in the bias voltage, attractive and repulsive forces act alternately between the surface of the charging roller 21 and the surface of the photosensitive drum 1 in general and may cause vibrations on the charging roller 21. On the contrary, when the DC bias is used for charging, vibrations can not occur on the charging roller 21 and thus charging sounds can not be caused. If only the DC bias is applied on the charging roller 21, a charge eraser unit which erases residual charges is required while it is not required in the AC charging. Thus, it is possible to prevent occurrence of uncomfortable charging sounds by changing the charging system from the AC charging to the DC charging.

[Noise Reduction Method Applied to Noises Caused from the Writing Unit]

The writing unit 8 shown in FIGS. 4 to 6 has a noise problem when the polygon mirror 52 rotates at such a high speed as the number of revolutions reaches to 2000 rpm or more. Specifically, pure sound components increase in a motor sound due to the number of revolutions of the motor 56 and in a wind-hurtling sound caused from revolutions of the polygon mirror 52. As a result, psychoacoustic parameters increase in a value of tonality. In FIG. 6, assuming that the lid 57 has a thickness of t (cm), the communication hole 57*a* has a radius of r (cm), the sound absorbent chamber 58*a* has a volume of V ($cm^3$), and the velocity of sound has a value of c, the sound absorbent chamber 58*a* has the following frequency $f_0$,

[Equation 1]

$$f_0 = \frac{c}{2\pi}\sqrt{\frac{\pi r^2}{V(t+0.8r)}}\ \text{(Hz)} \tag{1}$$

As indicated in the above equation, an air flowing through the sound absorbent chamber 58*a* and the communication hole 57*a* exhibits a high flow-speed at the frequency $f_0$. Accordingly, an air resistance in the communication hole 57*a* can silence a sound of the above frequency $f_0$.

Therefore, an extremely large silence effect can be achieved if a frequency of the motor sound, $f_1$=the number of revolutions of the motor per second (Hz), due to the number of revolutions of the motor 56, meets with the frequency $f_0$. In addition, an extremely large silence effect can be also achieved if a frequency of the wind-hurtling sound, $f_2$=the number of revolutions of the motor per second× the number of the reflective surfaces 52*a* (Hz), caused from revolutions of the polygon mirror 52, meets with the frequency $f_0$.

As described in this embodiment, the sound absorbent chamber 58*a* is adjusted to have a resonant frequency resonating with the frequency of the motor sound, $f_1$, due to the number of revolutions of the motor 56 to reduce the motor sound from the motor 56. Alternatively, the sound absorbent chamber 58*a* is adjusted to have a resonant frequency resonating with the frequency of the wind-hurtling sound, $f_2$, caused from revolutions of the polygon mirror 52 to reduce the wind-hurtling sound from the polygon mirror 52.

In relation to image forming apparatus according to the second embodiment, "Arrangement of Image forming apparatus", "Derivation of Sound quality evaluative equation for Image forming apparatus", and "Measures for reducing Uncomfortable sounds from Image forming apparatus" are described in turn.

(Arrangement of Image Forming Apparatus)

Figure 13:
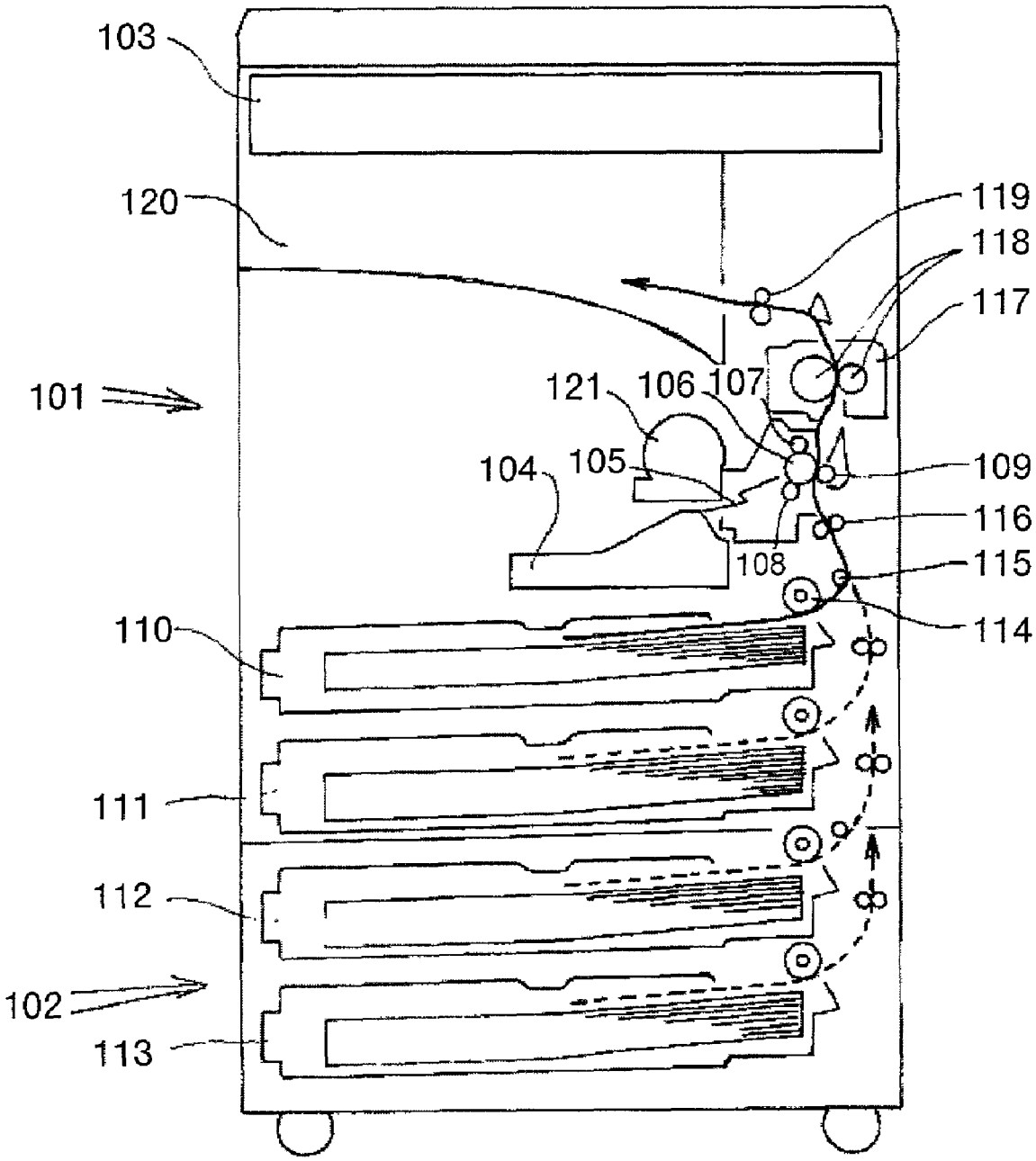
FIG. 13 is a view (front view) of the essential part in an arrangement for illustrating an image forming apparatus according to a second embodiment.

FIG. 13 is a front view outlining an example of image forming apparatus or a digital copier according to a second embodiment. The entire arrangement and operation of the image forming apparatus will be briefed first.

The image forming apparatus shown in FIG. 13 has such an arrangement that is roughly classified into a body 101 and a feed bank unit 102 capable of two-stage paper feeding. As the body 101 includes a two-stage feed tray, the image forming apparatus can exert its function by only comprising the body 101 without the feed bank unit 102. A supply storage table (not shown) can be attached instead of the feed bank unit 102, because the table has the same outline as the feed bank unit 102 and is cheaper than it.

In FIG. 13, the full-line arrow indicates a paper feeding route on image formation in the case of paper feeding from a first stage tray 110 in the body 101. The dotted line indicates a paper feeding route in the case of paper feeding from a second stage tray 111 in the body 101, or a first stage tray 112 or a second stage tray 113 in the feed bank unit 102. In the latter cases, independent of the tray to be employed, a recording paper is finally merged into the same route as that from the first stage tray 110 in the body 101.

The body 101 includes an image carrier or drum-like photosensitive member 106 therein and, around it, a charging roller 107, a writing optical unit 104, a developing roller 108 and a transfer roller 109. The body 101 further includes a reading optical unit 103, a pair of resist rollers 116, a toner bottle 121, a fusing device 117 and a pair of eject rollers 119.

Operations of the image forming apparatus shown in FIG. 13 will be described. First, the reading optical unit 103 reads image data from a document and converts it into a digital electric signal. This digital electric signal is subjected to image processing and then sent to the writing optical unit 104. The writing optical unit 104 emits a light beam 105 to the photosensitive member 106 in response to the digital electric signal. The photosensitive member 106 is driven rotationally in the counterclockwise direction in the figure while the charging roller 107 charges its surface uniformly. The writing optical system 104 writes a document image into the charged surface as described above to form an electrostatic latent image on the photosensitive member 106. The developing roller 108 visualizes this electrostatic latent image as a toner image. Toner is supplied from the toner bottle 121 to a developing unit that contains the developing roller 108.

An operation of feeding a recording paper is described with an example of paper feeding from the first stage tray 110 in the body 101. The feed roller 114 separates a sheet of recording paper from the first stage tray 110 that accommodates a plurality of recording papers stacked therein. The separated sheet of recording paper is assisted by a transport-support roller 115 to sharply turn upwardly, then pushed against the pair of resist rollers 116 for resist and timing adjustments, and finally directed to the image forming section.

The image formed from toner on the photosensitive member 106 is transferred to a recording paper when it passes in between the photosensitive member 106 and the transfer roller 109. Thereafter, the recording paper is conveyed to the fusing device 117, where the pair of fusing roller 118 in the fusing device 117 fixes toner on the recording paper. Then, the recording paper is ejected through the pair of the eject rollers 119 to the eject tray 120. The image forming apparatus according to this embodiment has an image formation speed of 122 mm/s, for example, which enables images to be formed 27-sheets per minute.

(Derivation of Sound Quality Evaluative Equation for Image Forming Apparatus)

Combining and weighting psychoacoustic parameters that greatly effect on uncomfortable sounds from the relatively high-speed running image forming apparatus, the inventors have successfully derived a sound quality evaluative equation for assuming a subjective evaluation value of sound quality, that is, an objective, sound quality evaluative equation. The inventors have also successfully proposed, in the sound quality evaluative equation derived, a condition that gives no uncomfortable feeling. The derivation of the sound quality evaluative equation for the image forming apparatus and the condition that gives no uncomfortable feeling will be described below.

When a degree of discomfort is objectively evaluated on a mechanical sound, a standard for measuring the degree of discomfort is required. A noise meter is employed to evaluate energy of a sound. Similar to this case, it is required to measure some physical amounts of a sound, assigning the values of the physical amounts into a sound quality evaluative equation, and evaluating the degree of discomfort from the computed values.

Subjective evaluation experiments (comparisons of sounds) are performed on humans to obtain scores of sounds. A sound quality evaluative equation is employed to predict discomfort of a sound using the above scores and a plurality of psychoacoustic parameter values. A multiple regression analysis is executed to create the sound quality evaluative equation using a combination of plural sets of psychoacoustic parameters against the discomfort of the sound.

The psychoacoustic parameters for use in the sound quality evaluative equation must be statistically significant (meaningful) as high as 95% or more. Psychoacoustic parameters prepared for an analyzer, available from Head Acoustics Inc., include loudness, tonality, sharpness, roughness, relative approach, impulsiveness and so forth.

The inventors implemented tests for subjective evaluation on uncomfortable sounds. Examples are described below. The subjective evaluation tests and derivation of the sound quality evaluative equation are implemented in the following procedures. The tests were implemented in an almost same manner as the subjective evaluation tests in the first embodiment.

(1) Recording of running sounds from Image forming apparatus by Dummy head, (2) Processing of the running sounds, production of plural processed sounds (Production of Sample sounds), (3) Computation of psychoacoustic parameters and sound pressure levels of the produced sample sounds, (4) Experiments on sample sounds by paired comparisons→Computation of subjective evaluation values against uncomfortable sounds (i.e., scoring of sounds), and (5) Multiple regression analysis based on subjective evaluation values against uncomfortable sounds and measured values of psychoacoustic parameters→Derivation of a sound quality evaluative equation (i.e., creation of an equation for predicting a score of a sound using the psychoacoustic parameters).

Each step is specifically described below.

(1) Collection of Running Sounds from Image Forming Apparatus,

Running sounds were collected from front surfaces of image forming apparatus, under the following measurement conditions, through a dummy head, HMS (Head Measurement System), available from Head Acoustics Inc., and were binaurally recorded into a hard disc. The binaurally recorded sounds can be reproduced through a special headphone that replays them feelingly as if a person actually listens to the mechanical sounds.

[Measurement Conditions]

Recording environment, Semi-anechoic chamber
Location of ears in the dummy head, A height of 1.2 m
Horizontal distance from a machine end, 1 m
Width direction, The center of the machine
Recording mode, FF (free field→for anechoic chamber)
HP filter, 22 Hz (2) Processing of Running Sounds to Produce Plural Processed Sounds (Production of Sample Sounds)), Collected sounds were processed using sound quality analysis software, Artemis, available from Head Acoustics Inc. Such a method of processing running sounds was employed, that would attenuate or emphasize a part associated with a main sound source in the image forming apparatus, among a recorded running sound, on a frequency axis or on a time axis. The sound sources selected at this time include four sources of paper feeding sound, metallic impact sound, paper slipping sound and main motor driving sound. For each sound source, a sound pressure level is shifted among three levels (emphasized, original and attenuated) to produce nine sample sounds 1 to 9, based on an orthogonal table L9, with combinations of different sound source levels. The sample sound 1 is an original sound from the image forming apparatus.

(3) Computation of Psychoacoustic Parameters and Sound Pressure Levels of the Produced Sample Sounds, The produced sample sounds were subjected to measurements of values of psychoacoustic parameters using sound quality analysis software, Artemis, available from Head Acoustics Inc. Measured results on psychoacoustic parameters of the sample sounds are shown in Table 4.

(4) Experiments on Sample Sounds by Scheff's Method of Paired Comparisons (Ura's Modified method)→Computation of Subjective Evaluation Values Against Uncomfortable Sounds, Subjects for evaluating sample sounds were gathered to compare paired sample sounds with each other and determine which one was felt uncomfortable. The "Ura's modified method" is a method of paired comparisons, which can be described below. Taking a comparison order into consideration, one subject compares all combinations once. Specifically, combinations each including two samples are created from t-samples, and N-subjects compare (i, j) with (j, i) in all combinations, thereby obtaining subjective evaluation values on sample sounds and ordering them. For example, in comparison of the sample sound 1 with the sample sound 2, a subjective evaluation value on the sample sound 1 is calculated to get 1 point if the sample sound 1 is felt uncomfortable and −1 point if the sample sound 2 is felt uncomfortable. Results were totaled and statistically processed, resulting in a subjective evaluation value, α, obtained on each sample sound. The larger the subjective evaluation value α, the more the sound is felt uncomfortable. Subjective evaluation values, α, on every sample sound are shown in Table 4. Table 4 shows subjective evaluation values α on sample sounds and measured values of psychoacoustic parameters.

TABLE 4

SUBJECTIVE EVALUATION VALUES ON SAMPLE SOUNDS AND MEASURED VALUES OF PSYCHOACOUSTIC PARAMETERS

| SAMPLE SOUND | SUBJECTIVE EVALUATION VALUE α | LOUDNESS (sone) | TONALITY (tu) | SHARPNESS (acum) | ROUGHNESS (asper) | RELATIVE APPROACH | IMPUL-SIVENESS (iu) | SOUND PRESSURE LEVEL dB(A) |
|---|---|---|---|---|---|---|---|---|
| SAMPLE SOUND 1 | −0.379 | 6.85 | 0.05 | 2.40 | 1.45 | 0.29 | 0.40 | 51.0 |
| SAMPLE SOUND 2 | 0.627 | 9.00 | 0.06 | 2.85 | 1.65 | 0.32 | 0.40 | 56.3 |
| SAMPLE SOUND 3 | −0.735 | 4.80 | 0.04 | 2.05 | 1.05 | 0.26 | 0.48 | 47.1 |
| SAMPLE SOUND 4 | 0.484 | 7.85 | 0.04 | 3.10 | 1.55 | 0.30 | 0.45 | 54.6 |
| SAMPLE SOUND 5 | −0.052 | 6.90 | 0.05 | 1.80 | 1.45 | 0.30 | 0.43 | 55.7 |
| SAMPLE SOUND 6 | 0.297 | 7.55 | 0.07 | 2.25 | 1.55 | 0.32 | 0.42 | 57.7 |
| SAMPLE SOUND 7 | −0.595 | 5.65 | 0.08 | 1.80 | 1.15 | 0.29 | 0.42 | 49.2 |
| SAMPLE SOUND 8 | 0.261 | 6.30 | 0.04 | 2.80 | 1.35 | 0.28 | 0.48 | 52.1 |
| SAMPLE SOUND 9 | 0.092 | 6.80 | 0.05 | 3.15 | 1.35 | 0.30 | 0.42 | 50.1 |

Sound levels and acoustic power levels are standardized in ISO 7779. The acoustic power levels are determined for standards (i.e., values to be complied) in German Blue-angel mark, Nordic Eco-label and Japanese Eco-mark standards. Among psychoacoustic parameters, only the loudness is standardized in ISO 532B but is not determined as a standard. As for other psychoacoustic parameters than the loudness, the same fundamental concept can be applied, however, programs and computations are different from one another due to a unique research according to each measurement instrument maker. Therefore, measured values usually differ slightly from each other in accordance with makers. In this experiment, the dummy head HMS III and the acoustic analyzer BAS or Artemis, all available from Head Acoustics Inc., were employed particularly.

(5) Multiple Regression Analysis Based on Subjective Evaluation Values Against Uncomfortable Sounds and Measured Values of Psychoacoustic Parameters, With the use of the same method as that in the first embodiment, a multiple regression analysis was executed with subjective evaluation values α and psychoacoustic parameters. Results from the multiple regression analysis are omitted. Using the results from the multiple regression analysis, a sound quality evaluative equation (e) for predicting a subjective evaluation value α from the psychoacoustic parameters was derived as below. Both constants and segments of the sound pressure level and sharpness are results statistically 95% significant. $R^2$ (contribution rate) employed for representing a precision of the sound quality evaluative equation was equal to 0.95. This means that the sound pressure level and sharpness contribute to 95% discomfort of a sound. The rest 5% discomfort is felt from other factors. A predicted value of this subjective evaluation value α is called a discomfort index S. This discomfort index S has no unit.

$$S=A\times(\text{Sound pressure level})+B\times(\text{Sharpness value})+C \quad (e)$$

where A, B and C denote multiple regression coefficients and show ranges in the cases of 95% reliable zones, $$0.066 \leqq A \leqq 0.120$$

$$0.342 \leqq B \leqq 0.709$$

$$-7.611 \leqq C \leqq -4.776$$

If the above multiple regression coefficients A, B and C are employed as averages within the ranges, the discomfort index S can be represented by the following sound quality evaluative equation (f), $$S=0.093\times(\text{Sound pressure level})+0.525\times(\text{Sharpness value})-6.194 \quad (f)$$

The sound pressure level ranges between 47.1 to 57.7 dB (A), as shown in Table 4, and the sharpness value ranging between 1.80 to 3.15 (acum).

It was found that the discomfort felt from the image forming apparatus can be represented by the sound pressure level (sound energy) and the sharpness (contents of components with high frequencies, especially frequencies of 4 kHz or more). Accordingly, measures for sound sources highly correlating with these psychoacoustic parameters can relieve discomfort from sounds.

According to the sound quality evaluative equations (e) and (f), other psychoacoustic parameters than the sound pressure level and sharpness have no relation with the discomfort or they have the relation but have a high correlation with the sound pressure level or sharpness. Therefore, they can not be significant psychoacoustic parameters even if assigned into the sound quality evaluative equations. Even the psychoacoustic parameter currently unrelated to discomfort, however, if the image forming apparatus has a value of the psychoacoustic parameter larger than the current state, may possibly effect on the discomfort.

On the contrary, the psychoacoustic parameter currently related to discomfort through the sound pressure level and sharpness, if it has a value larger than the current state, may possibly turn into the most discomfort psychoacoustic parameter effecting on the discomfort as replacement of the sound pressure level and sharpness. Accordingly, it can be concluded from Table 4 that the sound quality evaluative equations (e) and (f) can be held within the ranges that satisfy the following conditions, Loudness of 9.00 (sone) or below Tonality of 0.08 (tu) or below Roughness of 1.65 (asper) or below Relative approach of 0.32 or below Impulsive of 0.48 (iu) or below In the following Table 5, with respect to sound quality on discomforts in the sample sounds 1 to 9, subjective evaluation values α (experimentally measured values) and discomfort indexes S (values predicted by the sound quality evaluative equation (f)) are compared. Table 5 shows comparisons of discomfort indexes S (values predicted by the sound quality evaluative equation (f)) to subjective evaluation values α (experimentally measured values).

TABLE 5

COMPARISON OF DISCOMFORT INDEX S WITH SUBJECTIVE EVALUATION VALUE

| | DISCOMFORT INDEX S (PREDICTED VALUE BY THE EQUATION) | SUBJECTIVE EVALUATION VALUE α |
|---|---|---|
| SAMPLE SOUND 1 | −0.190 | −0.379 |
| SAMPLE SOUND 2 | 0.545 | 0.627 |
| SAMPLE SOUND 3 | −0.737 | −0.735 |
| SAMPLE SOUND 4 | 0.518 | 0.484 |
| SAMPLE SOUND 5 | −0.067 | −0.052 |
| SAMPLE SOUND 6 | 0.360 | 0.297 |
| SAMPLE SOUND 7 | −0.672 | −0.595 |
| SAMPLE SOUND 8 | 0.123 | 0.261 |
| SAMPLE SOUND 9 | 0.121 | 0.092 |

Figure 14:
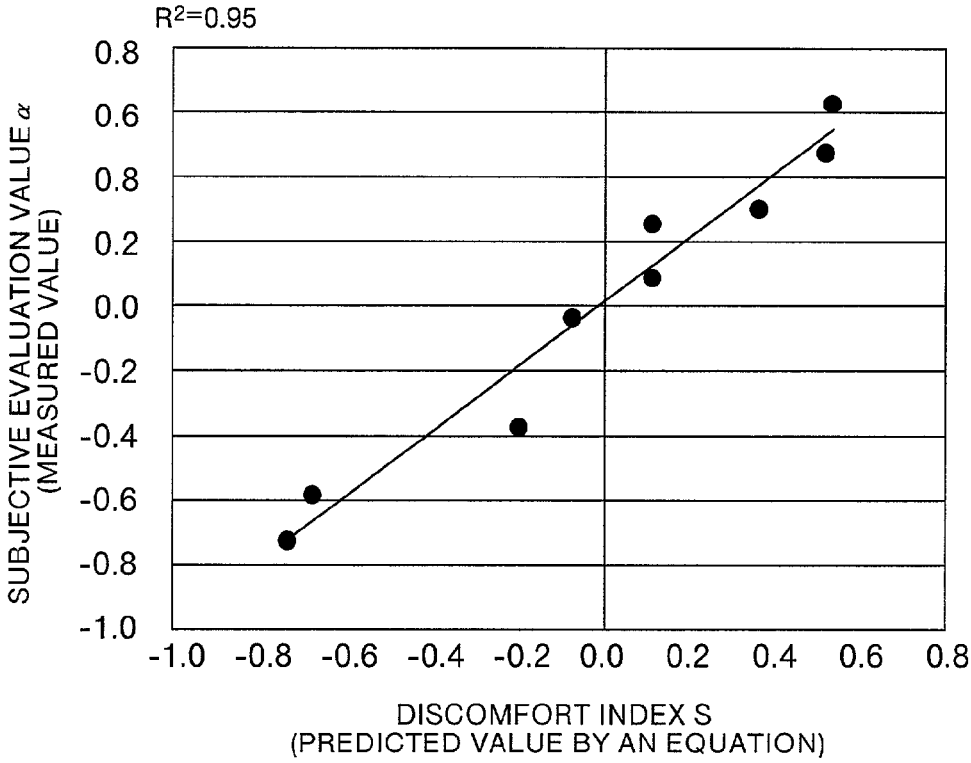
FIG. 14 is a graph which shows relations between a discomfort index S (a predicted value by an equation) and a subjective evaluation value $\alpha$ (an experimentally measured value)

FIG. 14 is a distribution view plotting the results in Table 5. The subjective evaluation value α resulted from the subjective evaluation experiment on human has a nice correlation with the S-value. Accordingly, the use of the sound quality evaluative equation (f) allows the sound quality to be evaluated objectively on discomfort.

Table 6 collectively shows results from experiments on the discomfort index S, which indicate a certain degree of the discomfort index S that is required to eliminate discomfort. Subjects are directed to hearing of 21 sounds, including the sample sounds 1 to 17 obtained by processing the running sound from A-machine and the running sounds from B-through E-machines, to evaluate them on discomfort in three ranks. Evaluations were indicated with A for a sound evaluated good, C for a sound evaluated bad and B for a sound evaluated medium. CC is employed to indicate a sound on which all subjects evaluated C-rank, and AA a sound on which all subjects evaluated A.

TABLE 6

RESULTS FROM ABSOLUTE EVALUATION ON SOUNDS

| SAMPLE SOUND | DISCOMFORT INDEX S (PREDICTED VALUE BY THE EQUATION) | EVALUATION |
|---|---|---|
| 2 | 0.545 | CC |
| 4 | 0.518 | CC |
| 6 | 0.360 | CC |
| 10 | 0.156 | CC |
| 8 | 0.123 | C |
| 9 | 0.121 | C |
| 12 | 0.104 | B |
| 14 | 0.031 | B |
| 16 | −0.055 | B |
| 5 | −0.067 | B |
| 17 | −0.076 | B |
| 13 | −0.173 | B |
| 1 | −0.190 | B |
| 11 | −0.448 | A |
| 15 | −0.453 | A |
| 8 | −0.672 | AA |
| 3 | −0.737 | AA |

In accordance with the results in Table 6, if a condition, $S \leqq -0.448$ . . . (g), can be satisfied, an uncomfortable feeling is relieved. Determination of the loudness and sharpness values in the sound quality evaluative equation (f) so as to satisfy the condition (g) can provide an image forming apparatus that has a relieved uncomfortable feeling.

If a condition, $S \leqq -0.672$ . . . (h), can be satisfied, it is possible to provide an image forming apparatus that causes a sound with discomfort hardly felt.

Figure 15:
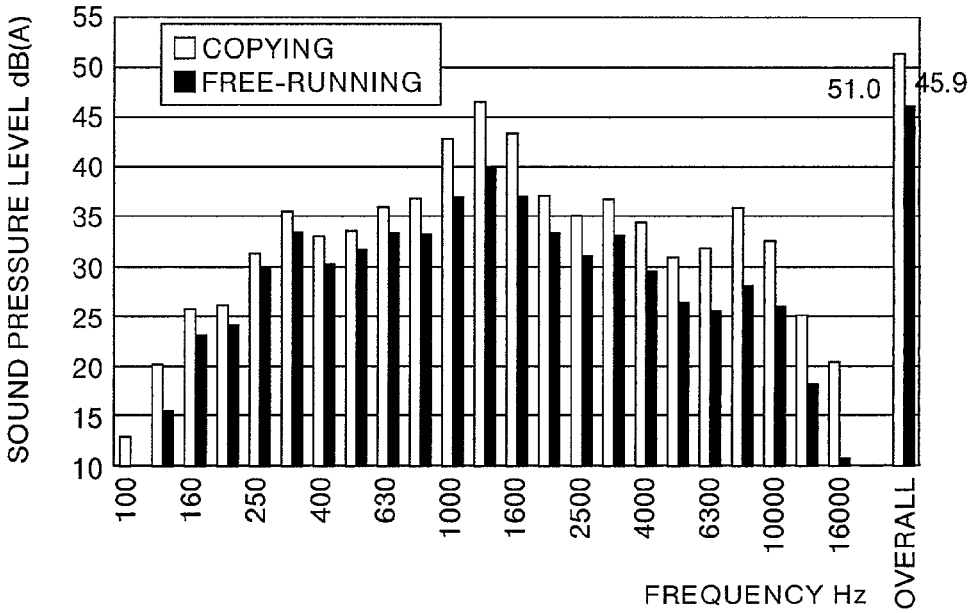
FIG. 15 is a graph which shows noise frequency distributions by comparison at the times of copying and free running.

FIG. 15 shows an example of a result from frequency analysis (⅓-octave band analysis) to noises from the image forming apparatus in FIG. 13. In this figure, the lateral axis indicates frequencies and the longitudinal axis indicates sound pressure levels, showing comparisons between a paper-passing copy mode and a free-running mode (a copy mode without passing a recording paper). A difference in sound pressure levels per frequency bandwidth is due to whether a recording paper is passed or not and is a frequency distribution in a sound due to paper conveying.

It is found from the same figure that the frequency distribution in noises due to paper conveying covers the entire band but exhibits frequent occurrences of noises in bands particularly having a central frequency of 1 kHz or more. When values in overalls or totals of all frequency bands are compared with each other, between a value of 51.0 dB (A) on the paper-passing copy mode and a value of 45.9 dB(A) on the free-running mode, there is a difference of 5.1 dB. The sharpness value calculated using the acoustic analysis software, Artemis, available from Head Acoustics Inc., indicates 2.4 (acum) on the paper-passing copy mode and 1.9 (acum) on the free-running mode.

Assigning the sound pressure level and sharpness value into the sound quality evaluative equation (f) yields $S=-0.922$, which can satisfy both conditions of $S \leqq -0.448$ . . . (g) and $S \leqq -0.672$ . . . (h).

As obvious from the above result, it is possible to improve the sound quality by lowering the noises in relation to the paper conveying. The sound in the free-running mode can not be improved to this level practically because it has no noises from the paper conveying. Nevertheless, it is possible to improve the noises in relation to the paper conveying so as to satisfy the conditions (g) and (h) both.

(Method of Reducing Uncomfortable Sounds from Image Forming Apparatus)

In order to satisfy the above conditions (g) and (h) in the sound quality evaluative equations (e) and (f), it is required to reduce noises caused from paper conveying in the image forming apparatus in FIG. 13. Such a noise reduction method will be described.

Figure 16:
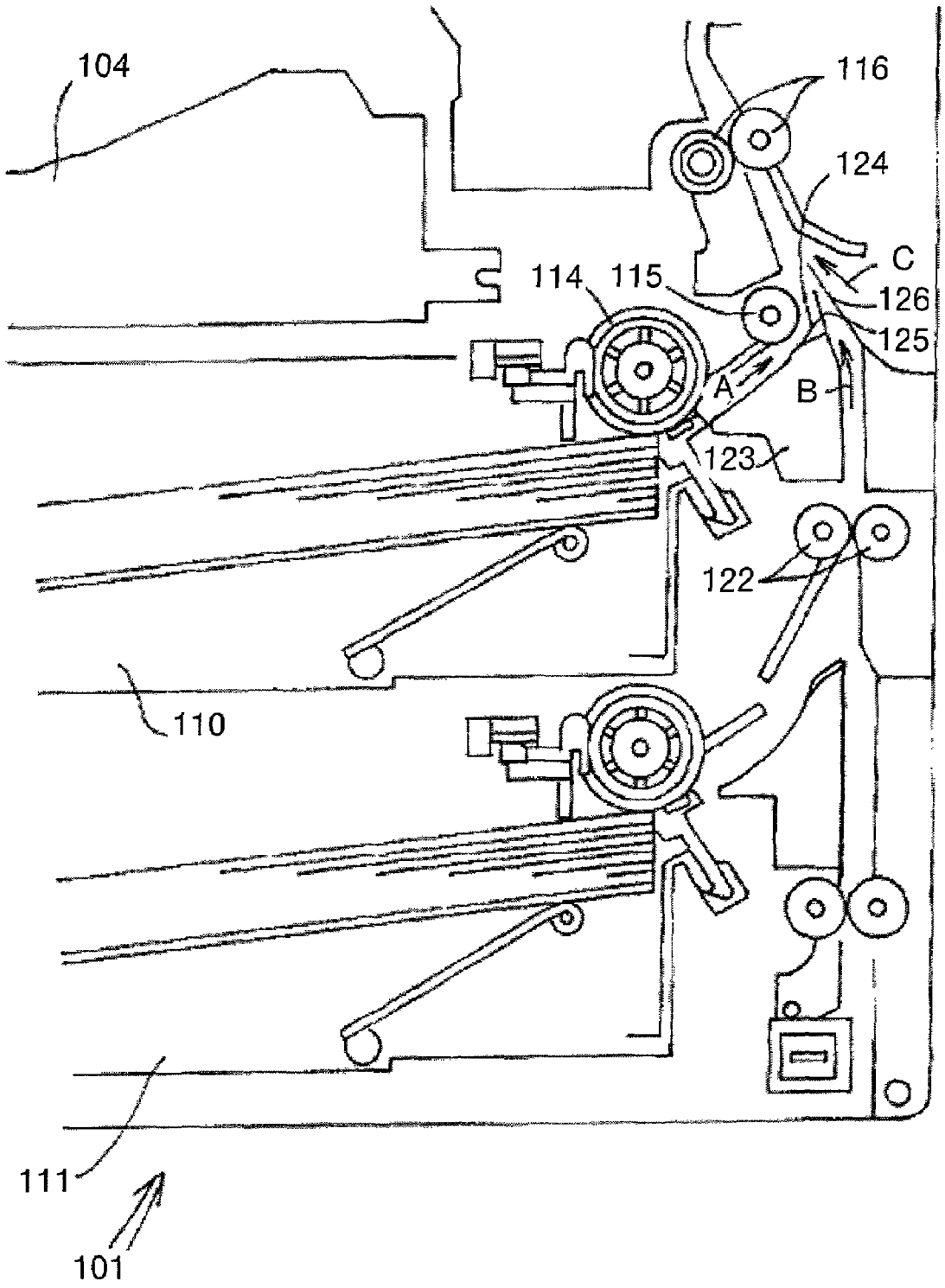
FIG. 16 is a front view which shows the essential part in an image forming apparatus with improved sound quality.
Figure 17:
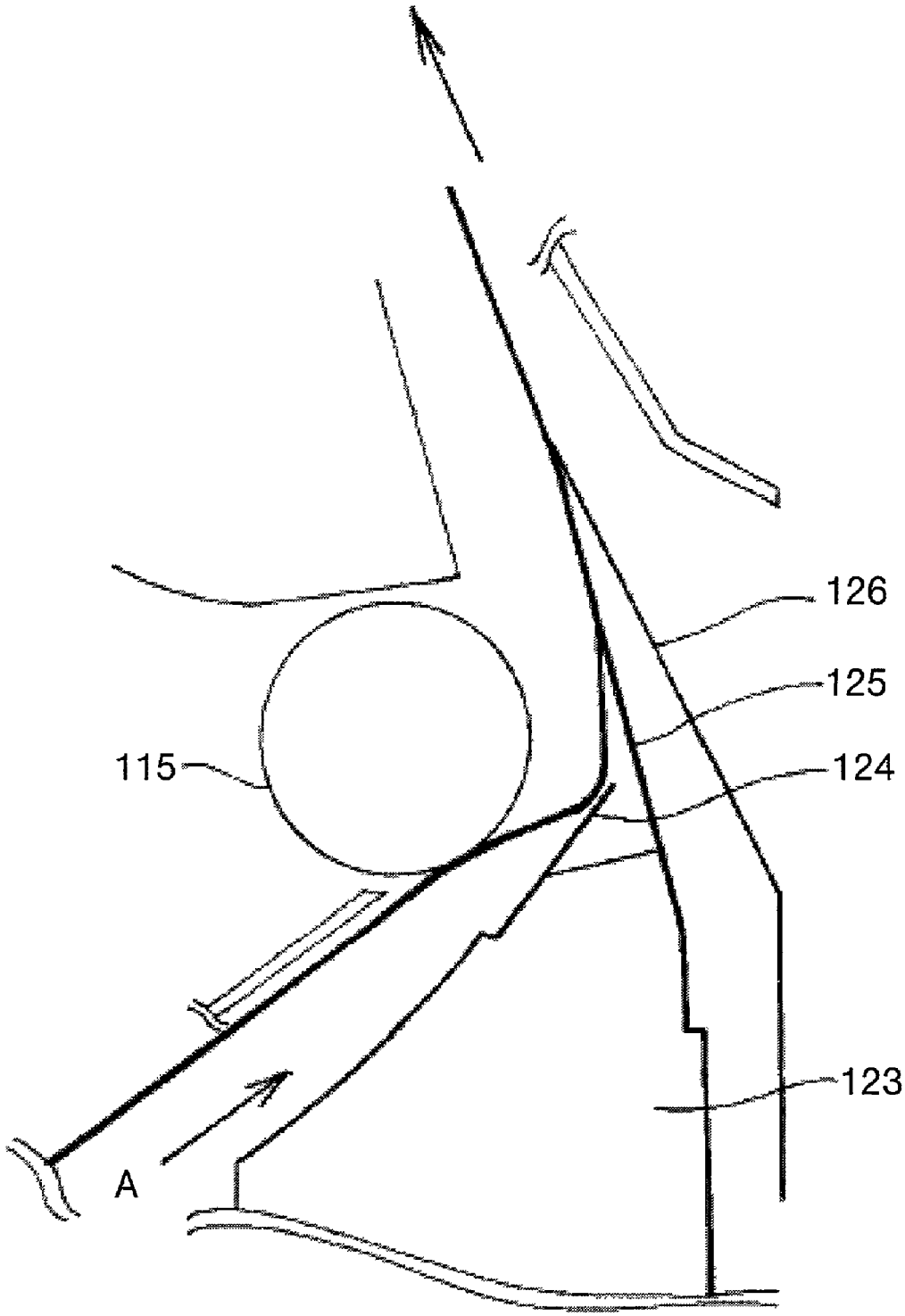
FIG. 17 is a front view which shows an example of an arrangement from a location to feed a recording paper to a location to resist it in the image forming apparatus in FIG. 16.
Figure 18:
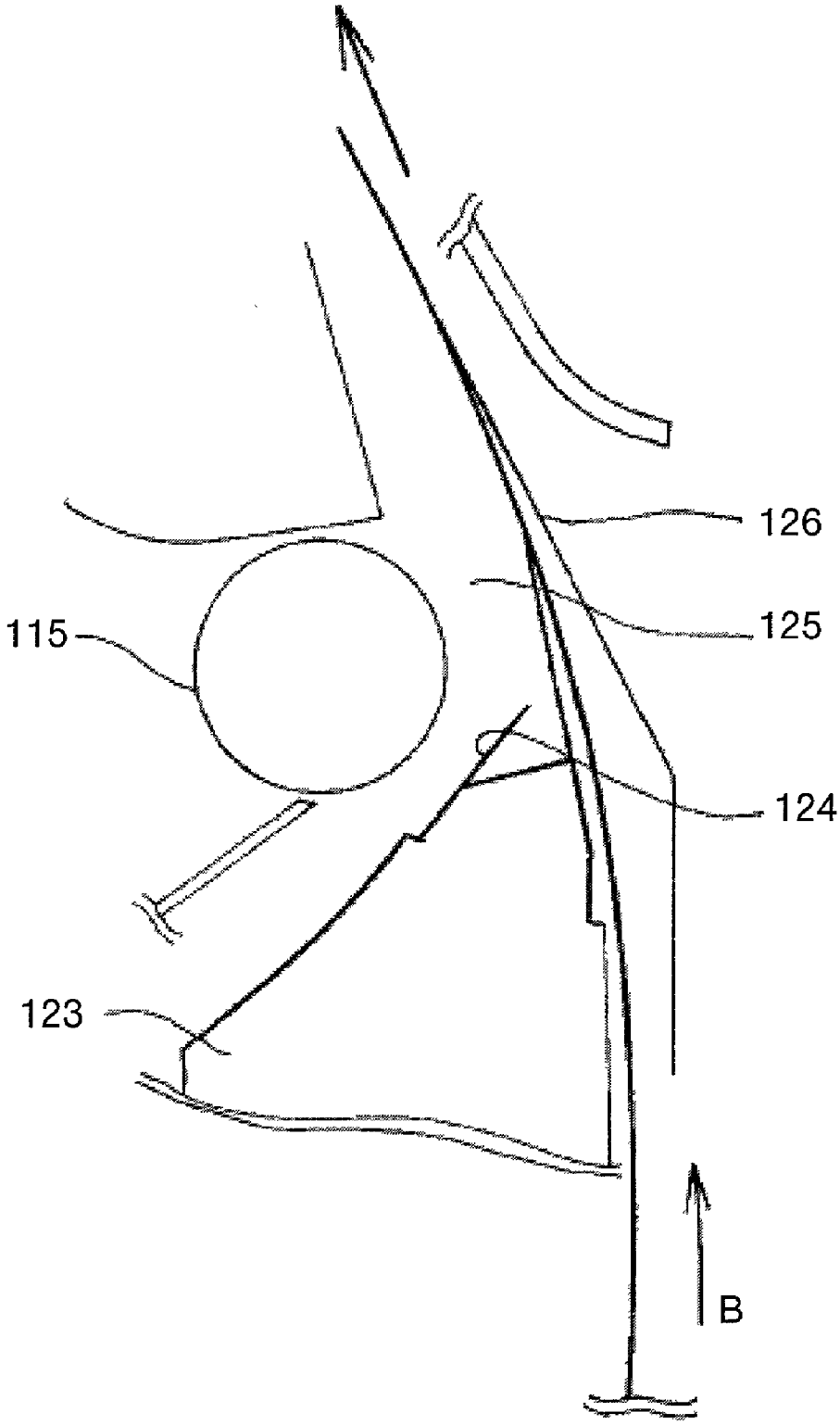
FIG. 18 is a front view which shows an example of an arrangement from a location to feed a recording paper to a location to resist it in a different paper conveying path in the image forming apparatus in FIG. 16.
Figure 19:
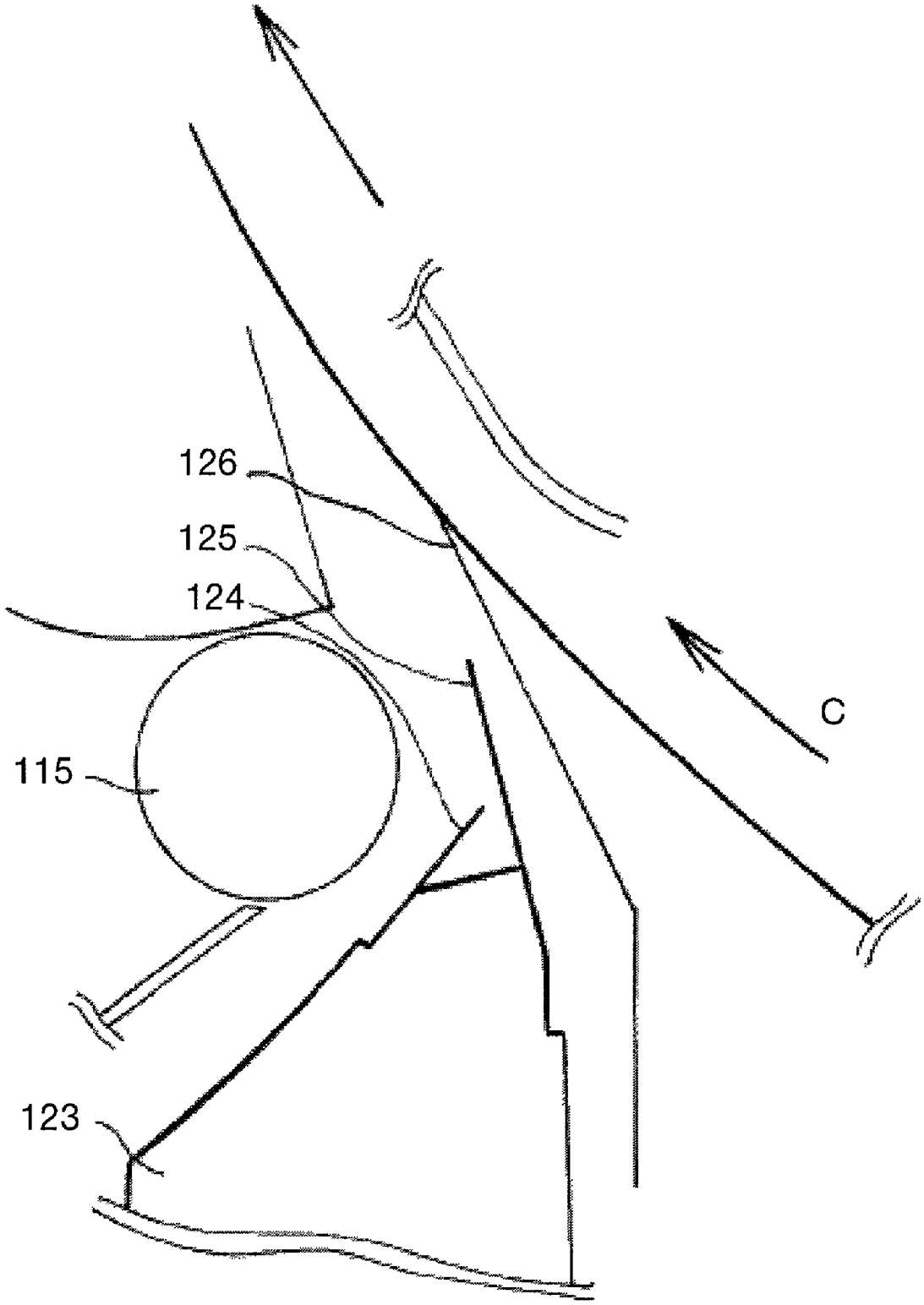
FIG. 19 is a front view which shows an example of an arrangement from a location to feed a recording paper to a location to resist it in a yet further paper conveying path in the image forming apparatus in FIG. 16.

FIG. 16 is a cross-sectional view showing an example of arrangement from paper feeding to resist in an image forming apparatus such as a copier. FIGS. 17 to 19 illustrate arrangement examples around the transport-support roller 115 and flexible sheets 124, 125, 126 in paper-conveying paths.

The paper-conveying paths are described first. In FIG. 16, a recording paper is fed from the first stage tray 110 in the body 101 according to the feed roller 114. Then, it is guided by a transport guide 123, the transport-support roller 115 and the flexible sheets 124, 125, 126 (hereinafter referred to as "milers") to turn and conveyed to the pair of resist rollers 116 (the arrow A). If a recording paper is fed from the second stage tray 111 or another tray below the second stage tray 111, the recording paper is guided by the milers 125, 126 and conveyed to the pair of resist rollers 116 (the arrow B). If a recording paper is conveyed from an external double-sided device (not shown) optionally provided, it is guided by the miler 126 along the arrow C and conveyed to the pair of resist rollers 116. Enlarged views of these three paper-conveying paths (conveying-paths along the arrows A, B and C) are respectively shown in FIGS. 17 to 19.

As these three paper-conveying paths are merged together as described, the milers 124, 125, 126 consisting of flexible sheets are employed as many paper guides as possible to smoothen paper conveying. When the miler is employed as the guide, however, a tip edge of the miler often slidably contacts the recording paper.

Figure 20:
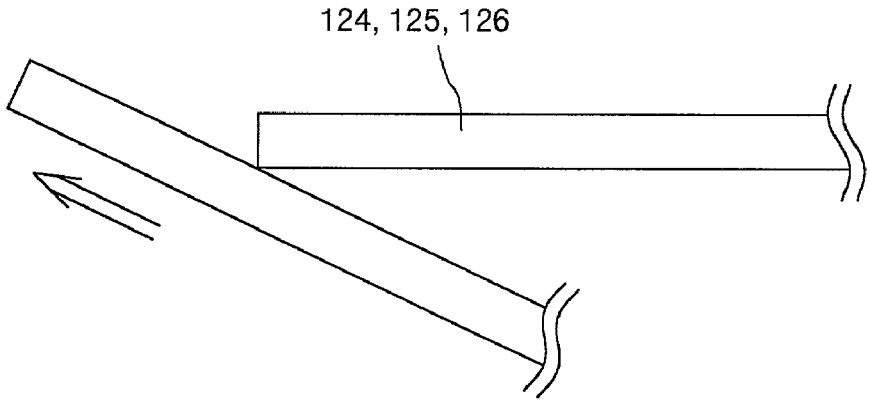
FIG. 20 is a front view which briefs an example of a paper conveying path that serves as a noise source.

FIG. 20 shows the milers 124, 125, 126, serving as guides, slipping their tip edges on the recording paper. The recording paper has fibrous roughness on its surface. On the contrary, the milers 124, 125, 126 consisting of flexible sheets are sheared and accordingly may have sharp edges and peripheral burrs. If the fibrous roughness on the paper surface is progressed, vibrations may occur between the burrs on the miler edges and the recording paper, resulting in large sounds, which lead to noises. Particularly, as the recording paper has a large area, it has a characteristic to radiate a sound easily.

Figure 21:
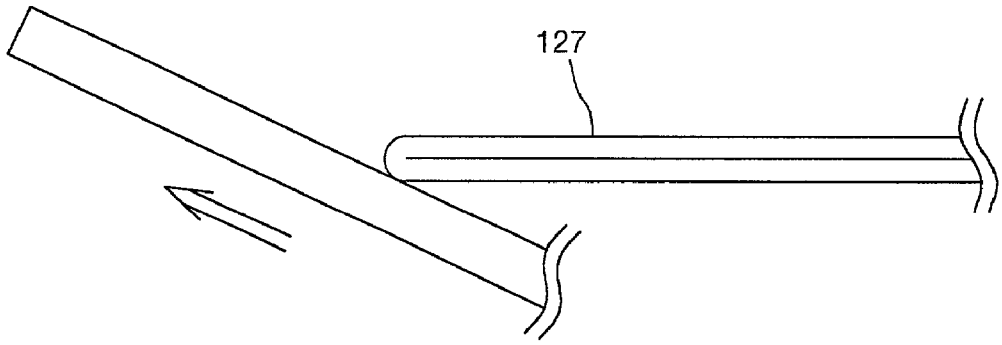
FIG. 21 is a front view which briefs an example of a paper conveying path that is solved to serve as a noise source.

Accordingly, this embodiment intends to prevent vibrations from occurring between the burrs on the miler edges and the recording paper as follows. FIG.21 illustrates measures for noises applied to a miler. In this figure, a miler 127 represents the milers 124, 125, 126 in FIG. 20, to which measures for noises are applied. The miler 127 shown in FIG. 21 has a half thickness or less compared to those of the milers 124, 125, 126 in FIG. 20 and is folded back and superimposed. The tip of the miler 127 presents a shape not edged but roundly folded back. The surface of the miler 127 is extremely smooth and does not lose its smoothness even at the folded portion. Therefore, even if the tip of the miler 127 slides against the fibrous roughness on the paper surface, no noises occur.

Figure 22:
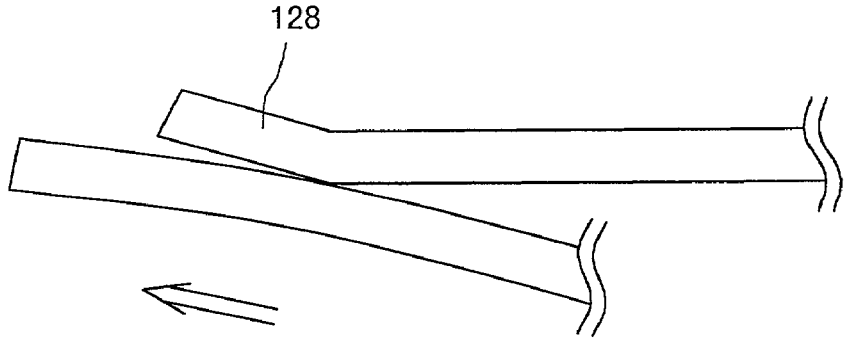
FIG. 22 is a front view which briefs another example of a paper conveying path that is solved to serve as a noise source.

If the route along the arrow C, or a paper-conveying route from an external double-sided device optionally provided, is not present, it is effective to employ such a miler 128 as shown in FIG. 22, instead of the mailer 126 having the folded tip. The miler 128 has a shape simply bent at an appropriate angle, on an appropriate portion near the tip, toward the outside of the paper-conveying path. The miler 128 with a smoothly curved surface can avoid occurrences of noises by sliding its folded portion against the recording paper.

Figure 23:
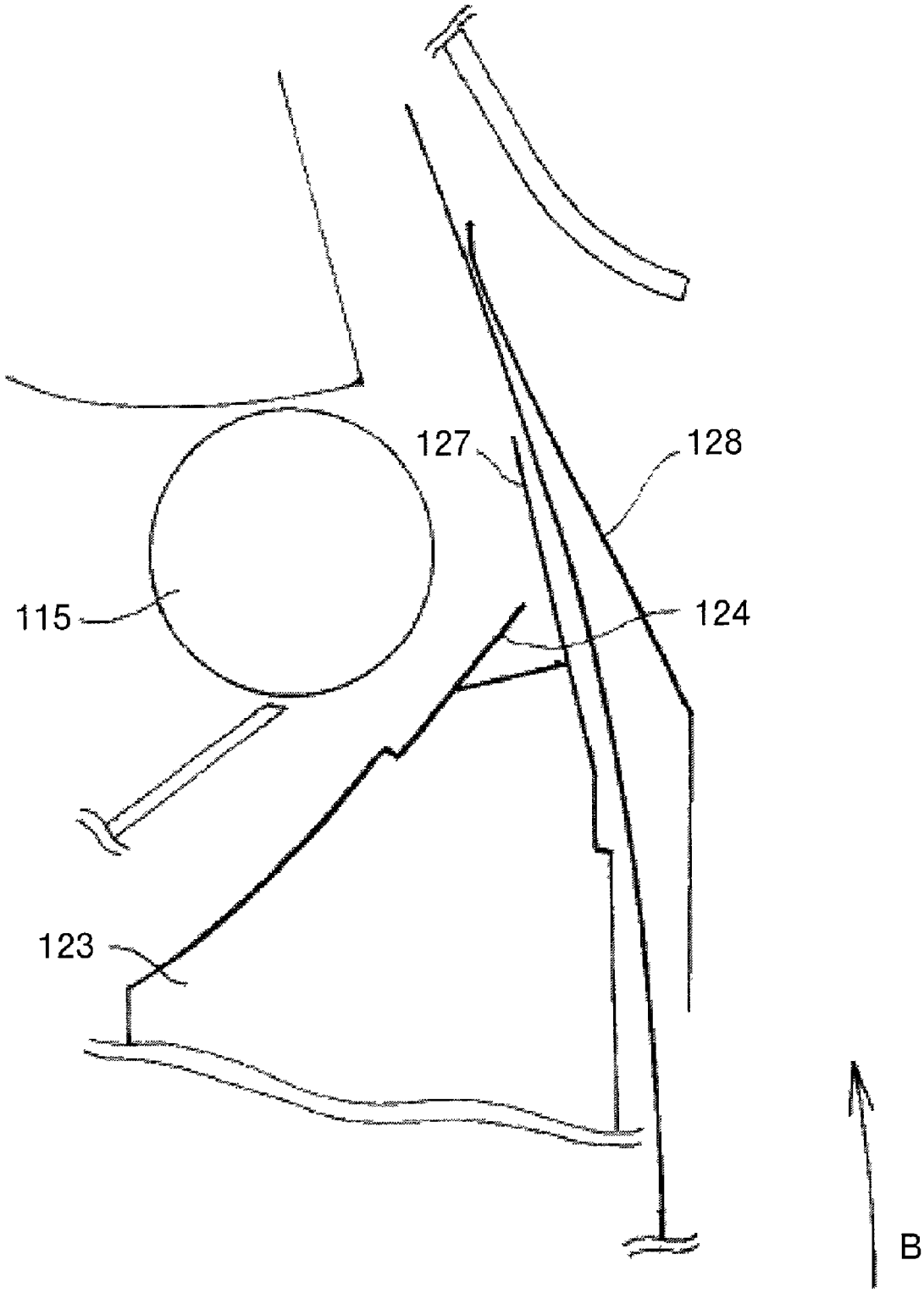
FIG. 23 is a front view which shows a paper conveying path applicable to the image forming apparatus of the present invention.

FIG. 23 shows a relation between the miler 128, of which appropriate portion near the tip is bent at an appropriate angle toward the outside of the paper-conveying path as shown in FIG. 22, and a recording paper. The recording paper is fed from the second stage tray 111 or another tray below it, as indicted by the arrow B. In this case, the recording paper, sliding against the folded portion of the miler 128, can avoid occurrences of noises caused from the edge of the miler 128 sliding against the recording paper.

In the above embodiment, the description was made on the slide between the tip of the miler and the recording paper. Though, it is possible to reduce sounds caused from the paper sliding by reviewing the portions that slide on the paper surface in the paper-conveying path and smoothening all such portions.

The present invention is not limited in the above embodiments but rather could be modified appropriately within the scope not departing from the spirit of the appended claims. For example, application of the sound quality evaluative equations and the conditions for the discomfort index of the present invention is not limited in the arrangements of the image forming apparatus shown in FIGS. 1 and FIG. 13. Rather, they can be applied widely to general image forming apparatus such as xerographic copiers and laser beam printers.

As described above, the method of evaluating sound quality on image forming apparatus according to the first aspect comprises, collecting a sound caused from image forming apparatus at a location apart a certain distance from the image forming apparatus, measuring a psychoacoustic parameter of the collected sound, deriving a subjective evaluation value from the collected sound through a subjective evaluation, subjecting the measured psychoacoustic parameter and the subjective value to a multiple regression analysis, computing a sound quality evaluative equation for assuming a subjective evaluation value, based on a result from the multiple regression analysis, using the psychoacoustic parameter, and computing a proper range of the subjective evaluation value assumed by the sound quality evaluative equation in the image forming apparatus. Therefore, it is effectively possible to provide a method of evaluating sound quality on image forming apparatus, which is capable of evaluating the sound quality objectively using the sound quality evaluative equation and applying measures for improving the sound quality in the image forming apparatus easily.

The image forming apparatus according to the second aspect is characterized by a discomfort index, S, which satisfies $S<-0.5$, wherein the discomfort index S is calculated with the following sound quality evaluative equation (a), using a loudness value and a tonality value, both psychoacoustic parameters obtained from the sound from the image forming apparatus at a location apart a certain distance from an end of the image forming apparatus, $$S=A\times(\text{Loudness value})+B\times(\text{Tonality value})+C \quad (a)$$

where coefficients A, B and C are determined $$0.247\leqq A\leqq 0.380$$

$$2.075\leqq B\leqq 4.890$$

$$-3.649\leqq C\leqq -2.643$$

Therefore, it is effectively possible to provide an image forming apparatus with a relieved uncomfortable feeling. This can be achieved, in a relatively slow running image formation, by deriving a sound quality evaluative equation using psychoacoustic parameters that have great improvement effects on discomfort sounds and using the sound quality evaluative equation.

In the image forming apparatus according to the third aspect, the coefficients in the second aspect are determined A=0.3135, B=+3.4824 and C=−3.1460. Therefore, in addition to the effect according to the second aspect, the optimal sound quality evaluative equation (a) can be employed.

In the image forming apparatus according to the fourth aspect, the psychoacoustic parameters, obtained from the sound from the image forming apparatus at a location apart a certain distance from an end of the image forming apparatus, satisfy conditions including a sharpness value ≦2.70 acum, a roughness value ≦1.24 asper and a fluctuation strength value ≦1.31 vacil. Therefore, the sound quality evaluative equation (a) can be employed under optimal conditions.

The image forming apparatus according to the fifth aspect at least comprises an image carrier for forming an image thereon, and a charging unit which applies an AC bias to charge the image carrier, in the fourth aspect, where in the AC bias has a frequency, f, which satisfies 200 Hz<f. Therefore, in addition to the effect according to the fourth aspect, it is possible to reduce the uncomfortable feeling caused from noises due to the AC bias.

The image forming apparatus according to the sixth aspect further comprises a charging sound reduction unit which reduces a charging sound caused during charging from the charging unit to the image carrier, in the fifth aspect. Therefore, in addition to the effect according to the fifth aspect, it is possible to reduce the charging sound on charging of the image carrier from the charging unit using the charging sound reduction unit.

In the image forming apparatus according to the seventh aspect, the frequency shifter in the sixth aspect shifts the eigenfrequency of the image carrier to a frequency different from a frequency obtained by multiplying the frequency f of the AC bias by a natural number. Therefore, in addition to the effect according to the sixth aspect, it is possible to reduce the charging sound by shifting the eigenfrequency of the image carrier to a frequency different from a frequency obtained by multiplying the frequency f of the AC bias by a natural number.

In the image forming apparatus according to the eighth aspect, the frequency shifter in the sixth aspect comprises a high-stiffness member for preventing the image carrier from vibrating, a sound absorber for absorbing a sound from the image carrier, or a damper for preventing the image carrier from vibrating. Therefore, in addition to the effect according to the sixth aspect, it is possible to reduce the charging sound by shifting the eigenfrequency of the image carrier to a frequency different from a frequency obtained by multiplying the frequency f of the AC bias by a natural number. This can be achieved with a simple and low-cost arrangement.

The image forming apparatus according to the ninth aspect at least comprises an image carrier for forming an image thereon, and a charging unit which applies a voltage to charge the image carrier, in the second aspect, wherein the charging unit charges the image carrier using a DC bias. Therefore, in addition to the effect according to the second aspect, it is possible to reduce the charging sound on charging of the image carrier from the charging unit.

The image forming apparatus according to the tenth aspect at least comprises an image carrier for forming an image thereon, and an image writing unit which writes an image on the image carrier using a polygon mirror and a motor for rotationally driving the mirror, in the second aspect. The image writing unit includes a housing unit constructing a closed space for housing the motor and the polygon mirror therein, an opening formed in a portion of a side wall constructing the housing unit, and a sound absorbent chamber provided outside the housing unit and in communication with the opening. Therefore, in addition to the effect according to the tenth aspect, it is possible in a relatively slow running image formation to relieve the uncomfortable feeling by improving the sound from the writing unit which writes into the image carrier.

The image forming apparatus according to the eleventh aspect, the sound absorbent chamber has a resonant frequency resonating with a frequency of a motor sound depending on the number of revolutions of the motor, in the tenth aspect. Therefore, in addition to the effect according to the tenth aspect, it is possible in a relatively slow running image formation to improve the sound from the writing unit by determining the sound absorbent chamber to have a resonant frequency resonating with a frequency of a motor sound depending on the number of revolutions of the motor.

The image forming apparatus according to the twelfth aspect, the sound absorbent chamber has a resonant frequency resonating with a frequency of a wind-hurtling sound caused from revolutions of the polygon mirror, in the tenth aspect. Therefore, in addition to the effect according to the tenth aspect, it is possible in a relatively slow running image formation to improve the sound from the writing unit by determining the sound absorbent chamber to have a resonant frequency resonating with a frequency of a wind-hurtling sound caused from revolutions of the polygon mirror.

According to the thirteenth aspect, an image forming apparatus is characterized by a discomfort index, S, which satisfies $S<-0.448$, wherein the discomfort index S is calculated with the following sound quality evaluative equation (e), using a sound pressure level (A characteristic) and, a sharpness value or a psychoacoustic parameter obtained from the sound from the image forming apparatus at a location apart a certain distance from an end of the image forming apparatus, $$S=A\times(\text{Sound pressure level})+B\times(\text{Sharpness value})+C \quad \text{(e)}$$

where coefficients A, B and C are determined $$0.066\leqq A\leqq 0.120$$

$$0.342\leqq B\leqq 0.709$$

$$-7.611\leqq C\leqq -4.776$$

Therefore, it is effectively possible to provide an image forming apparatus with a relieved uncomfortable feeling. This can be achieved, in a relatively fast running image formation, by deriving a sound quality evaluative equation using psychoacoustic parameters that have great improvement effects on discomfort sounds and using the sound quality evaluative equation.

In the image forming apparatus according to the fourteenth aspect, the coefficients in the thirteenth aspect are determined A=0.093, B=0.525 and C=−6.194. Therefore, in addition to the effect according to the thirteenth aspect, the optimal sound quality evaluative equation (e) can be employed.

In the image forming apparatus according to the fifteenth aspect, the psychoacoustic parameters, obtained from the sound from the image forming apparatus at a location apart a certain distance from an end of the image forming apparatus, in the thirteenth aspect, satisfy conditions including a loudness value ≦9.00 (sone), a tonality value ≦0.08 (tu), a roughness value ≦1.65 (asper), a relative approach ≦0.32 and an impulsiveness ≦0.48 (iu). Therefore, in addition to the effect according to the thirteenth aspect, the sound quality evaluative equation (e) can be employed under optimal conditions.

The image forming apparatus according to the sixteenth aspect at least comprises a paper conveying unit which conveys a recording paper. The paper conveying unit includes a guide member for guiding the recording paper, the guide member composed of a flexible sheet, the flexible sheet having a tip roundly folded for contacting with the recording paper. Therefore, in addition to the effect according to the thirteenth aspect, it is possible to reduce the sound caused from the paper sliding with the guide. Thus, it is effectively possible to provide an image forming apparatus with a reduced paper-conveying sound and a relieved uncomfortable feeling in a relatively fast image forming apparatus.

The image forming apparatus according to the seventeenth aspect at least comprises a paper conveying unit which conveys a recording paper. The paper conveying unit includes a guide member for guiding the recording paper, the guide member composed of a flexible sheet, the flexible sheet having a contact portion bent at an end for contacting with the recording paper. Therefore, in addition to the effect according to the thirteenth aspect, it is possible to reduce the sound caused from the paper sliding with the guide. Thus, it is effectively possible to provide an image forming apparatus with a reduced paper-conveying sound and a relieved uncomfortable feeling in a relatively fast image forming apparatus.

In the image forming apparatus according to the eighteenth aspect, the certain distance in the second, third or thirteenth aspect is determined approximately 1 m in accordance with ISO. Therefore, in addition to the effect according to the second, third or thirteenth aspect, it is possible to compute the discomfort index S with a standard method of measuring.

The present document incorporates by reference the entire contents of Japanese priority documents, 2000-396769 filed in Japan on Dec. 27, 2000, 2000-397056 filed in Japan on Dec. 27, 2000, 2001-083613 filed in Japan on Mar. 22, 2001, 2001-175196 filed in Japan on Jun. 11, 2001 and 2001-374924 filed in Japan on Dec. 7, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A method of evaluating sound quality on image forming apparatus, comprising:

collecting a sound caused from image forming apparatus at a location apart a certain distance from said image forming apparatus;

measuring a plurality of psychoacoustic parameters of the collected sound;

deriving a subjective evaluation value from the collected sound through a subjective evaluation;

subjecting said measured plurality of psychoacoustic parameters and the subjective value to a multiple regression analysis;

computing a sound quality evaluative equation for assuming a subjective evaluation value, based on a result from the multiple regression analysis, using said plurality of psychoacoustic parameters; and computing a proper range of the subjective evaluation value assumed by the sound quality evaluative equation in said image forming apparatus.

2. An image forming apparatus characterized by a discomfort index, S, which satisfies $S<-0.5$, wherein the discomfort index S is calculated with the following sound quality evaluative equation (a), using a loudness value and a tonality value, both psychoacoustic parameters obtained from the sound from said image forming apparatus at a location apart a certain distance from an end of said image forming apparatus:

$$S=A\times(\text{Loudness value})+B\times(\text{Tonality value})+C \quad \text{(a)}$$

where coefficients A, B and C are determined $$0.247\leqq A\leqq 0.380$$

$$2.075\leqq B\leqq 4.890$$

$$-3.649\leqq C\leqq -2.643.$$

3. The image forming apparatus according to claim 2, wherein the coefficients are determined A=0.3135, B=+3.4824 and C=−3.1460.

4. The image forming apparatus according to claim 2, wherein the plurality of psychoacoustic parameters, obtained from the sound from said image forming apparatus at a location apart a certain distance from said image forming apparatus, satisfy conditions including a sharpness value ≦2.70 acum, a roughness value ≦1.24 asper and a fluctuation strength value ≦1.31 vacil.

5. The image forming apparatus according to claim 2, at least comprising:

an image carrier for forming an image thereon; and a charging unit which applies an AC bias to charge said image carrier, wherein the AC bias has a frequency, f, which satisfies 200 Hz<f.

6. The image forming apparatus according to claim 5, further comprising a charging sound reduction unit which reduces a charging sound caused during charging from said charging unit to said image carrier.

7. The image forming apparatus according to claim 6, wherein said charging sound reduction unit comprises a frequency shifter provided on said image carrier for shifting the eigen frequency of said image carrier to a frequency different from a frequency obtained by multiplying the frequency f of the AC bias by a natural number.

8. The image forming apparatus according to claim 7, wherein said frequency shifter comprises a high-stiffness member for preventing said image carrier from vibrating, a sound absorber for absorbing a sound from said image carrier, or a damper for preventing said image carrier from vibrating.

9. The image forming apparatus according to claim 2, at least comprising:

an image carrier for forming an image thereon; and a charging unit which applies a voltage to charge said image carrier, wherein said charging unit charges said image carrier using a DC bias.

10. The image forming apparatus according to claim 2, at least comprising:

an image carrier for forming an image thereon; and an image writing unit which writes an image on said image carrier using a polygon mirror and a motor for rotationally driving said mirror, said image writing unit including a housing unit constructing a closed space for housing said motor and said polygon mirror therein, an opening formed in a portion of a side wall constructing said housing unit, and a sound absorbent chamber provided outside said housing unit and in communication with the opening.

11. The image forming apparatus according to claim 10, wherein said sound absorbent chamber has a resonant frequency resonating with a frequency of a motor sound depending on the number of revolutions of said motor.

12. The image forming apparatus according to claim 10, wherein said sound absorbent chamber has a resonant frequency resonating with a frequency of a wind-hurtling sound caused from revolutions of said polygon mirror.

13. The image forming apparatus according to claim 2, wherein the certain distance is determined as 1.00±0.03.

14. An image forming apparatus characterized by a discomfort index, S, which satisfies S<−0.448, wherein the discomfort index S is calculated with the following sound quality evaluative equation (e), using a sound pressure level (A characteristic) and, a sharpness value or a plurality of psychoacoustic parameters obtained from the sound from said image forming apparatus at a location apart a certain distance from an end of said image forming apparatus:

$$S=A\times(\text{Sound pressure level})+B\times(\text{Sharpness value})+C \quad \text{(e)}$$

where coefficients A, B and C are determined $$0.066\leqq A\leqq 0.120$$

$$0.342\leqq B\leqq 0.709$$

$$-7.611\leqq C\leqq -4.776$$

15. The image forming apparatus according to claim 14, wherein the coefficients are determined A=0.093, B=0.525 and C=−6.194.

16. The image forming apparatus according to claim 14, wherein the plurality of psychoacoustic parameters, obtained from the sound from said image forming apparatus at a location apart a certain distance from an end of said image forming apparatus, satisfy conditions including a loudness value ≦9.00 (sone), a tonality value ≦0.08 (tu), a roughness value ≦1.65 (asper), a relative approach ≦0.32 and an impulsiveness ≦0.48 (iu).

17. The image forming apparatus according to claim 14, at least comprising:

a paper conveying unit which conveys a recording paper, said paper conveying unit including a guide member for guiding said recording paper, said guide member composed of a flexible sheet, said flexible sheet having a tip roundly folded for contacting with said recording paper.

18. The image forming apparatus according to claim 14, at least comprising:

a paper conveying unit which conveys a recording paper, said paper conveying unit including a guide member for guiding said recording paper, said guide member composed of a flexible sheet, said flexible sheet having a contact portion bent at an end for contacting with said recording paper.

19. The image forming apparatus according to claim 14, wherein the certain distance is determined as 1.00±0.03.

* * * * *